US012398939B1

(12) United States Patent
Alexander et al.

(10) Patent No.: US 12,398,939 B1
(45) Date of Patent: Aug. 26, 2025

(54) PORTABLE CONTAINER

(71) Applicant: Ember LifeSciences, Inc., Westlake Village, CA (US)

(72) Inventors: Clayton Alexander, Westlake Village, CA (US); Damian Lee, Westlake Village, CA (US); Robert James Speck, Westlake Village, CA (US); Simon David James, Simi Valley, CA (US); Erik Aaron Camacho Covarrubias, Simi Valley, CA (US); Casey Koji Fukunaga, San Diego, CA (US)

(73) Assignee: Ember LifeSciences, Inc., Westlake Village, CA (US)

( * ) Notice: Subject to any disclaimer, the term of this patent is extended or adjusted under 35 U.S.C. 154(b) by 0 days.

(21) Appl. No.: 19/068,358

(22) Filed: Mar. 3, 2025

(51) Int. Cl.
*F25D 11/00* (2006.01)
*F25B 21/00* (2006.01)
*F25D 23/00* (2006.01)

(52) U.S. Cl.
CPC ..... *F25D 11/003* (2013.01); *F25B 21/00* (2013.01); *F25D 23/003* (2013.01); *F25B 2400/01* (2013.01); *F25D 2400/36* (2013.01)

(58) Field of Classification Search
CPC ..... F25D 11/003; F25D 2331/8014; F25B 21/02; A61J 1/165
See application file for complete search history.

(56) References Cited

U.S. PATENT DOCUMENTS 2,505,092 A 4/1950 Brewer
5,970,719 A 10/1999 Merritt
6,400,896 B1 6/2002 Longardner
9,151,531 B2 10/2015 Wengreen et al.
9,447,995 B2 9/2016 Bloedow et al.
9,648,970 B2 5/2017 Lee
(Continued)

FOREIGN PATENT DOCUMENTS

CN 108224868 A 11/2020
FR 2752504 A1 2/1998
(Continued)

OTHER PUBLICATIONS

KR-101478121-B1 translation.*

*Primary Examiner* — Elizabeth J Martin
(74) *Attorney, Agent, or Firm* — Knobbe, Martens, Olson & Bear LLP

(57) ABSTRACT

A portable container includes a cooling unit with a vessel and a base. A thermal cover can cover the vessel to insulate a chamber in the vessel that holds one or more goods. The vessel has a cavity filled with a phase change material or thermal mass, and thermally conductive plate(s) extending within the cavity and in thermal contact with the phase change material or thermal mass. The base is attached to the vessel and houses thermoelectric module(s) in thermal contact with the thermally conductive plate(s), a heat sink in thermal contact with the thermoelectric module(s), a fan operable to flow the air past the heat sink, and circuitry that operates the thermoelectric module(s) and fan. The thermoelectric modules are operable to charge the phase change material or thermal mass, the charged phase change material or thermal mass (once charged) configured to passively cool or heat the chamber.

20 Claims, 25 Drawing Sheets

(56) References Cited

U.S. PATENT DOCUMENTS

| | | | |
|---|---|---|---|
| 9,707,156 | B2 | 7/2017 | Wengreen et al. |
| 9,814,651 | B2 | 11/2017 | Wengreen et al. |
| 9,877,894 | B2 | 1/2018 | Wengreen et al. |
| 9,913,777 | B2 | 3/2018 | Wengreen et al. |
| 9,956,140 | B2 | 5/2018 | Wengreen et al. |
| 10,433,672 | B2 | 10/2019 | Alexander et al. |
| 10,610,451 | B2 | 4/2020 | Gray |
| 10,670,323 | B2 | 6/2020 | Alexander et al. |
| 10,989,466 | B2 | 4/2021 | Alexander et al. |
| 11,668,508 | B2 | 6/2023 | Alexander et al. |
| 11,965,679 | B2 | 4/2024 | Alexander et al. |
| 12,013,157 | B2 | 6/2024 | Alexander et al. |
| 2009/0049845 | A1 | 2/2009 | McStravick et al. |
| 2009/0277187 | A1 | 11/2009 | McGann |
| 2011/0083445 | A1 | 4/2011 | Heyd et al. |
| 2012/0312031 | A1 | 12/2012 | Olsen et al. |
| 2013/0016462 | A1 | 1/2013 | Howitt et al. |
| 2014/0343493 | A1 | 11/2014 | Wengreen |
| 2014/0354438 | A1 | 12/2014 | Hazen et al. |
| 2015/0245723 | A1 | 9/2015 | Alexander |
| 2016/0242598 | A1 | 8/2016 | Alexander |
| 2016/0262979 | A1 | 9/2016 | Wengreen et al. |
| 2017/0177883 | A1 | 6/2017 | Paterra et al. |
| 2018/0036202 | A1* | 2/2018 | Wengreen ..... A61M 5/002 |
| 2019/0003757 | A1 | 1/2019 | Miros et al. |
| 2020/0224964 | A1* | 7/2020 | Alexander ..... F25D 11/003 |

FOREIGN PATENT DOCUMENTS

| | | | | |
|---|---|---|---|---|
| FR | 2753071 | A1 | | 3/1998 |
| FR | 2808666 | A1 | | 11/2001 |
| GB | 735674 | A1 | | 8/1955 |
| KR | 101478121 | B1 | * | 12/2014 |
| WO | WO 2013/187763 | A1 | | 12/2013 |
| WO | WO 2015 084701 | A1 | | 6/2015 |
| WO | WO 2019/204660 | A1 | | 10/2019 |

* cited by examiner

PORTABLE CONTAINER

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present disclosure is directed to a portable container, and more particularly to a portable temperature controlled container, for example for medicine, such as insulin, vaccines, epinephrine, injector pens, etc.

Description of the Related Art

Certain medicine needs to be maintained at a certain temperature or temperature range to be effective (e.g., to maintain potency). Once potency of medicine (e.g., a vaccine, insulin, epinephrine) is lost, it cannot be restored, rendering the medicine ineffective and/or unusable. For example, injector pens are commonly used to deliver medication, such as epinephrine to counteract the effects of an allergic reaction (e.g., due to a peanut allergy, insect stings/bites, etc.). Users sometimes carry such medicine (e.g., medicine injector pens, cartridges for injector pens) with them (e.g., in a bag, purse, pocket, etc.) in the event they suffer an allergic reaction during the day. However, such medicine may be exposed to varying temperatures during the day (e.g., due to ambient temperature conditions, temperature conditions in the car, workplace, school, etc.), which can be outside the preferred temperature or temperature range for the medicine to be effective.

SUMMARY

Accordingly, there is a need for an improved portable container that can (passively) maintain goods in a temperature controlled state (e.g., in a cooled state, in a heated state) for a prolonged period of time.

In some aspects, the techniques described herein relate to a portable container, including: a cooling or heating unit including: a vessel including a non-continuous peripheral wall including one or more slits that separate the peripheral wall into two or more portions, the one or more slits extending from an open end to a closed end along a majority of a length of the vessel, the peripheral wall having an outer wall and an inner wall that defines an open chamber configured to receive and hold one or more goods proximate each other, the outer wall spaced from the inner wall and defining a cavity therebetween filled with a phase change material or thermal mass, one or more thermally conductive plates extending within the cavity and in thermal contact with the phase change material or thermal mass, and a base attached to the vessel, the base at least partially housing: one or more thermoelectric modules having one side in thermal contact with a thermally conductive support base in thermal contact with the one or more thermally conductive plates, a heat sink in thermal contact with an opposite side of the one or more thermoelectric modules, a fan operable to draw air through one or more intake openings into the base, flow the air past the heat sink, and exhaust the air from the base via one or more exhaust openings, one or more power storage devices, a visual display, and circuitry configured to operate the one or more thermoelectric modules, fan and visual display; and a thermal cover having a closed first end and an open second end, the thermal cover including an outer wall and an inner wall spaced apart from the outer wall, a gap between the inner wall and the outer wall configured to thermally insulate the inner wall relative to the outer wall, the thermal cover configured to removably extend over the vessel to close the chamber and so that the inner wall of the thermal cover is proximate the outer wall of the peripheral wall of the vessel, the thermal cover configured to thermally insulate the chamber, wherein the one or more thermoelectric modules is operable to charge the phase change material or thermal mass, the charged phase change material or thermal mass configured to passively cool or heat the chamber.

In some aspects, the techniques described herein relate to a portable container, including: a cooling or heating unit including: a vessel including a non-continuous peripheral wall including one or more slits that separate the peripheral wall into two or more portions, the one or more slits extending from an open end to a closed end along a majority of a length of the vessel, the peripheral wall having an outer wall and an inner wall that defines an open chamber configured to receive and hold one or more goods proximate each other, the outer wall spaced from the inner wall and defining a cavity therebetween filled with a phase change material or thermal mass, one or more thermally conductive plates extending within the cavity and in thermal contact with the phase change material or thermal mass, and a base attached to the vessel, the base at least partially housing: one or more thermoelectric modules having one side in thermal contact with a thermally conductive support base in thermal contact with the one or more thermally conductive plates, a heat sink in thermal contact with an opposite side of the one or more thermoelectric modules, a fan operable to draw air through one or more intake openings into the base, flow the air past the heat sink, and exhaust the air from the base via one or more exhaust openings, one or more power storage devices, a visual display, and circuitry configured to operate the one or more thermoelectric modules, fan and visual display, wherein the one or more thermoelectric modules is operable to charge the phase change material or thermal mass, the charged phase change material or thermal mass configured to passively cool or heat the chamber.

In some aspects, the techniques described herein relate to a portable container, including: a cooling or heating unit including: a vessel including a peripheral wall having an outer wall and an inner wall that defines an open chamber configured to receive and hold one or more goods proximate each other, the outer wall spaced from the inner wall and defining a cavity therebetween filled with a phase change material or thermal mass, one or more thermally conductive plates extending within the cavity and in thermal contact with the phase change material or thermal mass, and a base attached to the vessel, the base at least partially housing: one or more thermoelectric modules having one side in thermal contact with a thermally conductive support base in thermal contact with the one or more thermally conductive plates, a heat sink in thermal contact with an opposite side of the one or more thermoelectric modules, a fan operable to draw air through one or more intake openings into the base, flow the air past the heat sink, and exhaust the air from the base via one or more exhaust openings, and circuitry configured to operate the one or more thermoelectric modules and fan, wherein the one or more thermoelectric modules is operable to charge the phase change material or thermal mass, the charged phase change material or thermal mass configured to passively cool or heat the chamber.

DETAILED DESCRIPTION

FIGS. 1-16 shows a portable container 100 for one or more (e.g., two) goods (e.g., perishable goods, perishable medicine such as injector pens or injector pen cartridges). The portable container 100 can be sized to be hand carried (e.g., sized to be gripped by a single hand of a user).

Figure 13:
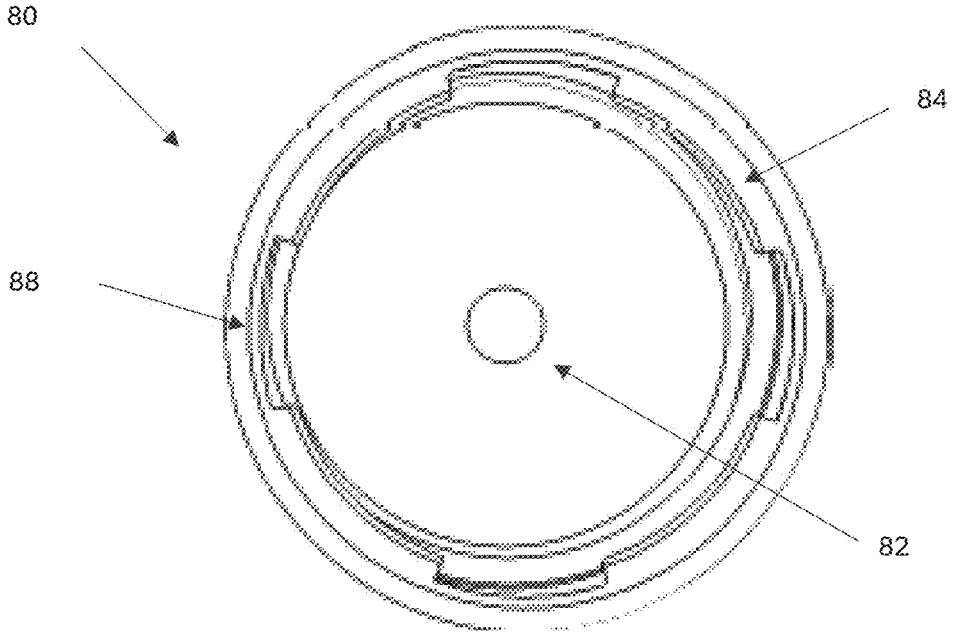
FIG. 13 is a schematic bottom view of a cover of the portable container of FIG. 1.
Figure 14:
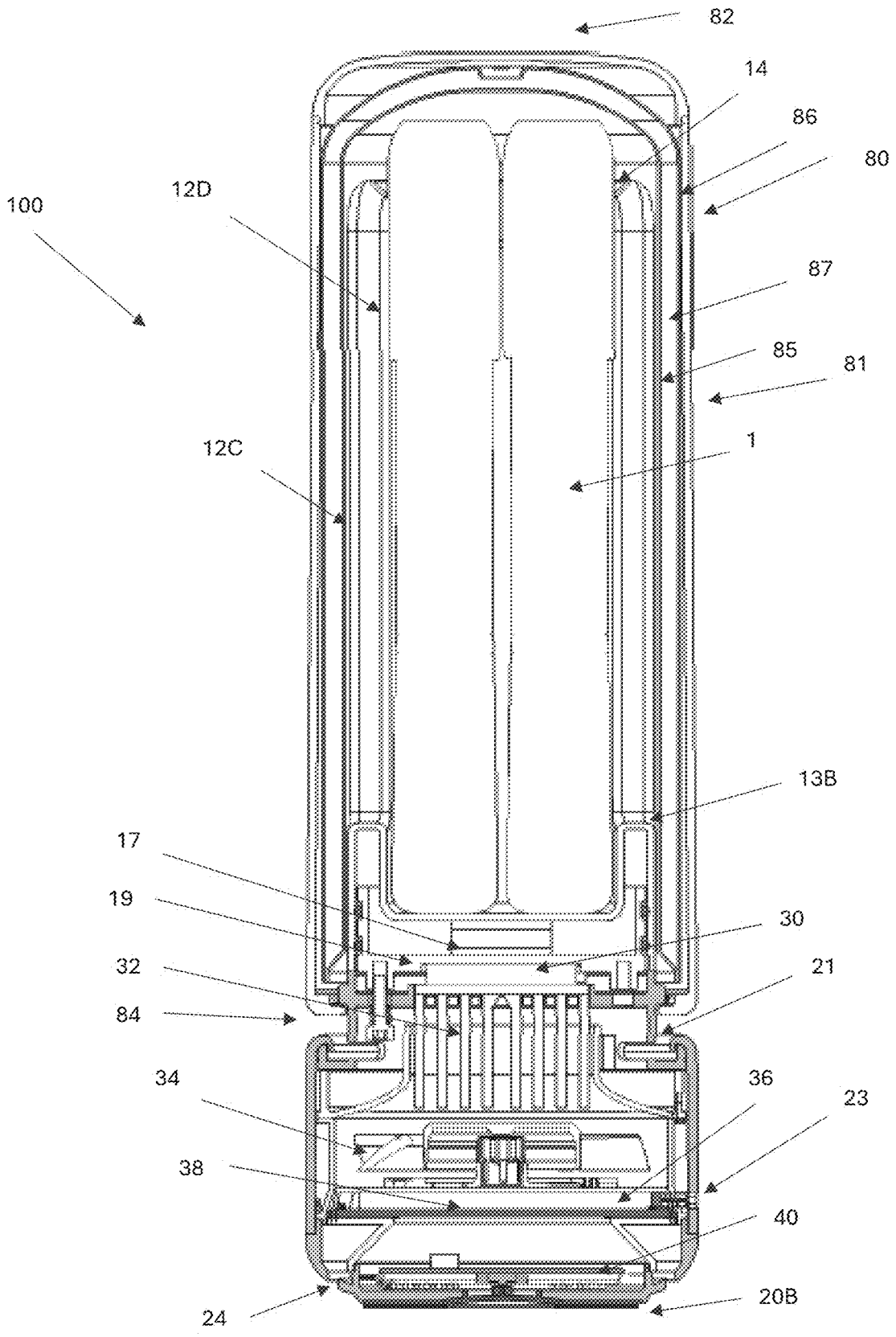
FIG. 14 is a schematic cross-sectional view of the portable container of FIG. 1 along line 14-14 in FIG. 1.
Figure 15:
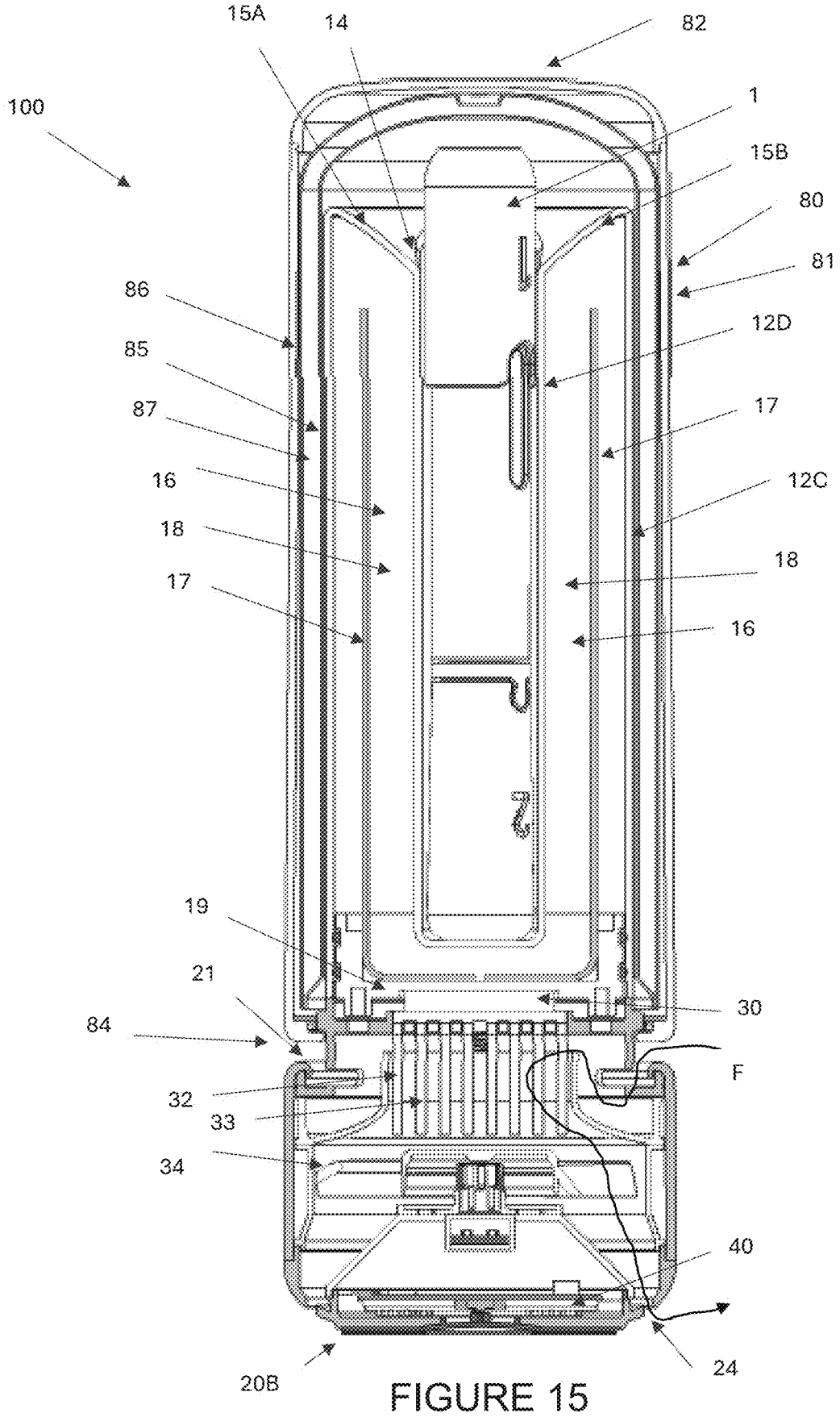
FIG. 15 is a schematic cross-sectional view of the portable container of FIG. 1 along line 15-15 in FIG. 1 and offset 90 degrees from the cross-sectional view in FIG. 14.

The portable container 100 includes a cooling unit 10 and a cover 80 (e.g. a thermal cover). The cover 80 has a peripheral wall 81 (e.g., a circumferential wall, cylindrical wall) that extends from a closed end 82 (e.g., a dome end) to an open end 84. With reference to FIGS. 13-14, the cover 80 can have an inner wall 85 (e.g., inner peripheral wall, inner circumferential wall, inner cylindrical wall) and an outer wall 86 (e.g., outer peripheral wall, outer circumferential wall, outer cylindrical wall) that is (radially) spaced from the inner wall 85 to define a gap 87 therebetween. The gap 87 thereby insulates the inner wall 85 relative to the outer wall 86. In one example, the gap 87 can be under vacuum. In another example, the gap 87 is filled with an insulating material (e.g., air, foam, etc.). With reference to FIG. 13, the cover 80 can have one or more (e.g., multiple) slots 88 at or proximate the open end 84 (e.g., as part of a key-slot locking arrangement) that facilitate locking the cover 80 to the vessel 10, as further discussed below. The inner wall 85 and outer wall 86 can extend to the closed end 82 (e.g., dome end), as shown in FIGS. 14-15. In one example, the cover 80 is a single piece (e.g., monolithic, seamless piece). In one example, the cover 80 is made of metal. In one example, the cover 80 is made of a plastic material. In one example, the cover 80 has a single wall instead of an inner wall and outer wall. In one example, the cover 80 can have a single wall made of an insulative material, such as foam.

Figure 1:
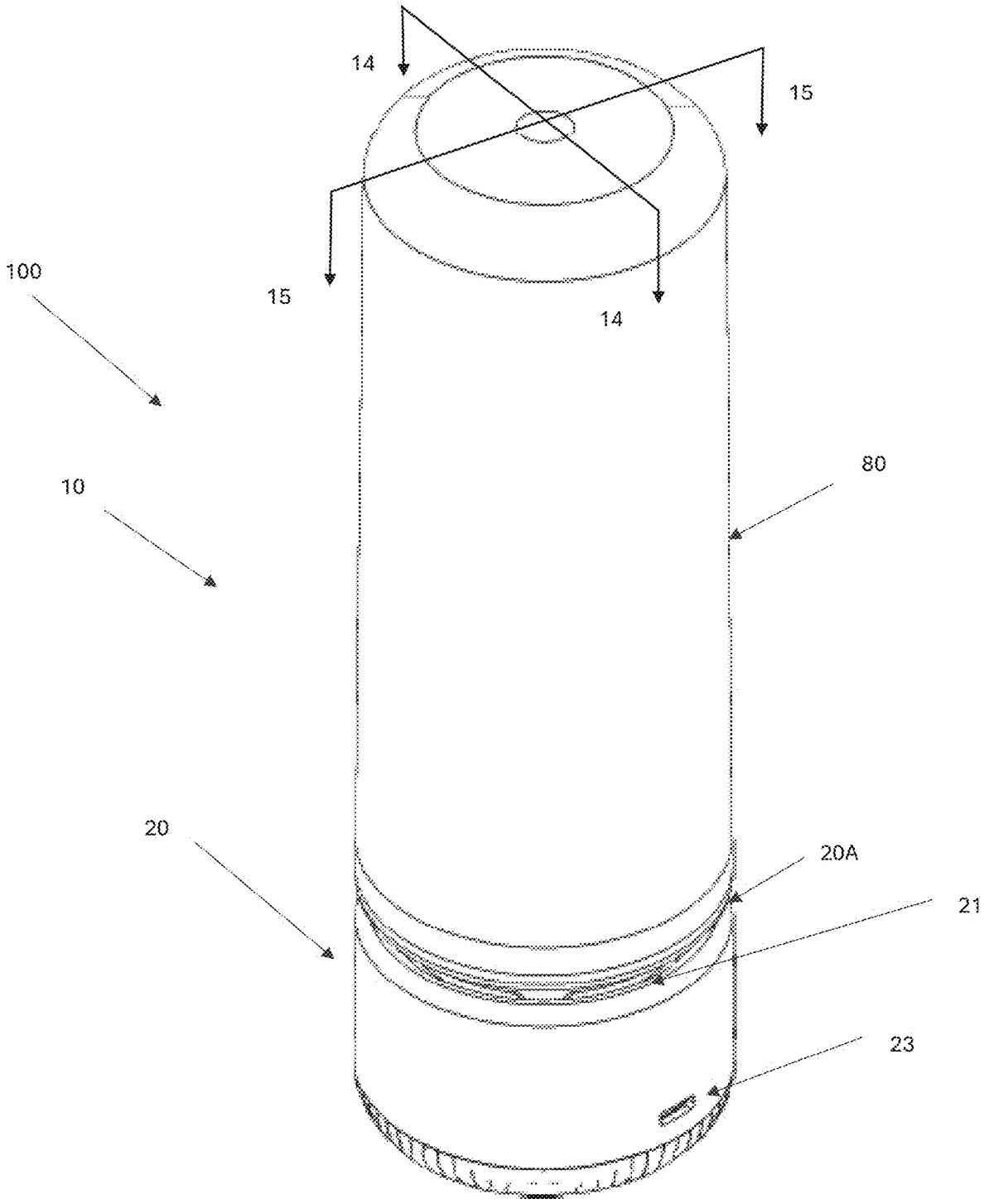
FIG. 1 is a schematic perspective view of a portable container.
Figure 2:
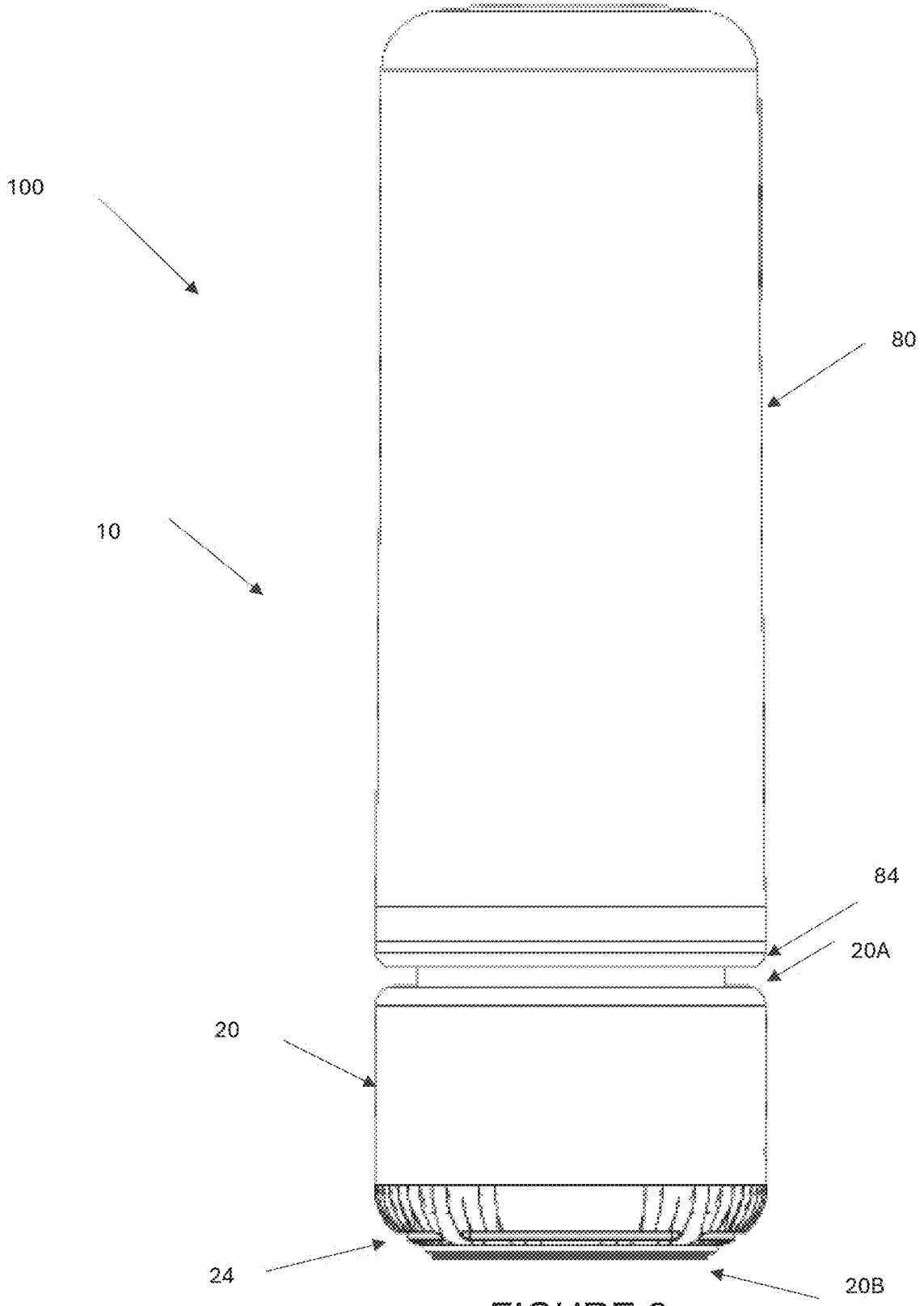
FIG. 2 is a schematic right-side view of the portable container of FIG. 1.
Figure 3:
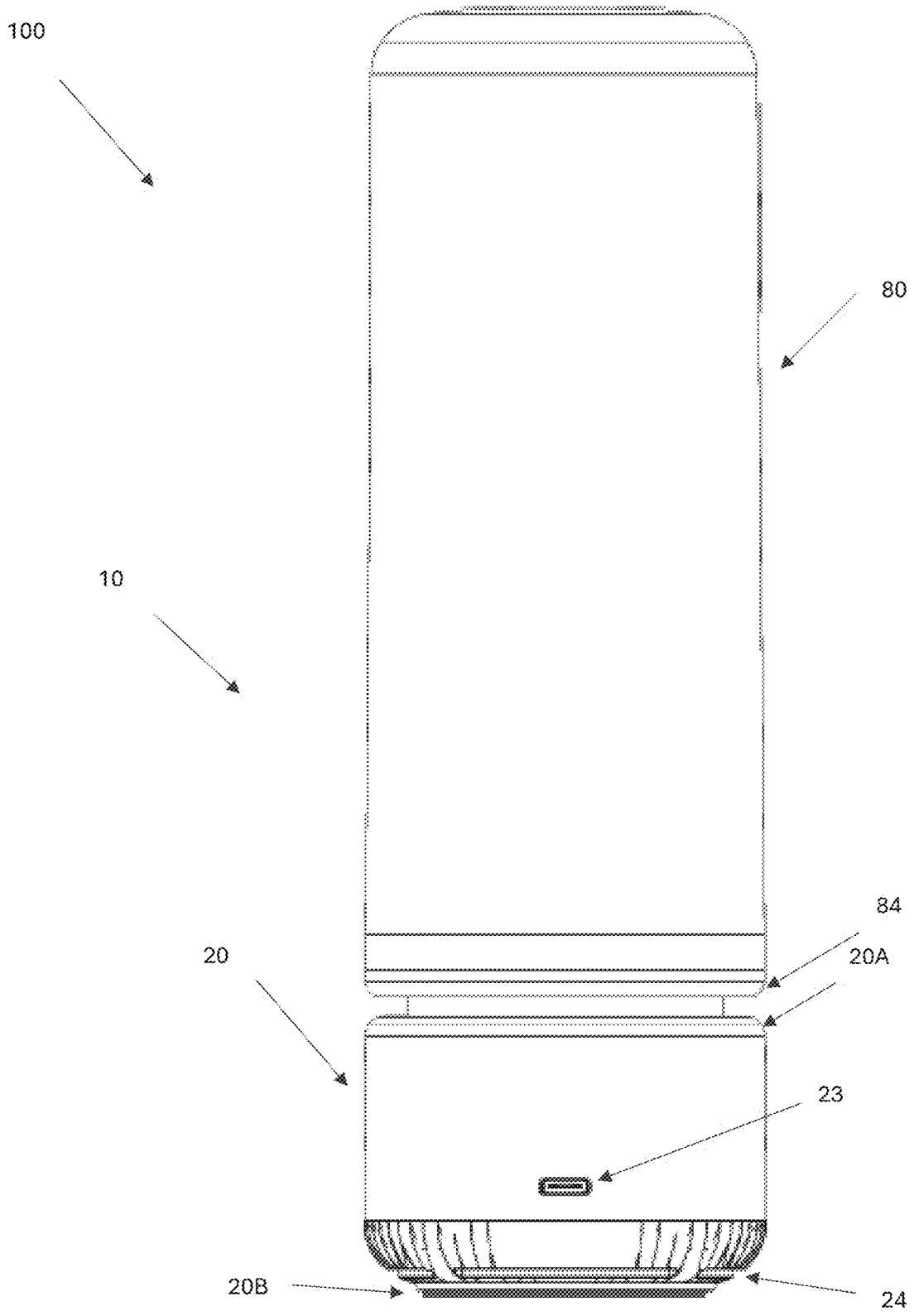
FIG. 3 is a schematic rear view of the portable container of FIG. 1.
Figure 4:
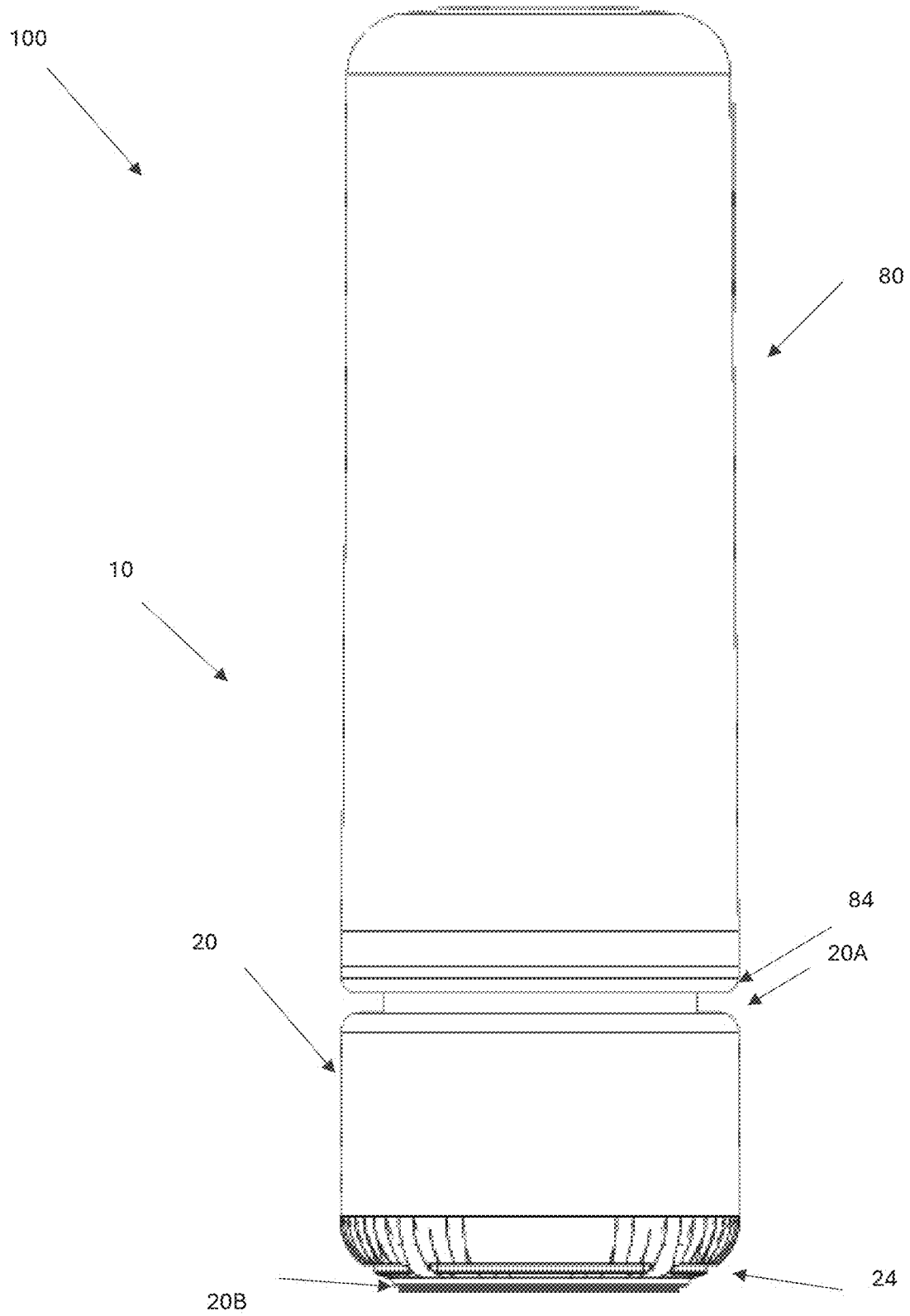
FIG. 4 is a schematic front view of the portable container of FIG. 1.
Figure 5:
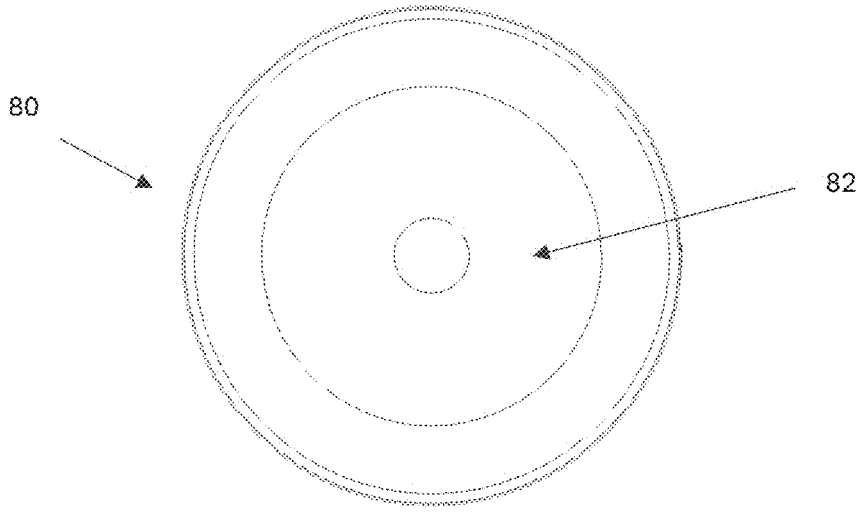
FIG. 5 is a schematic top view of the portable container of FIG. 1.
Figure 6:
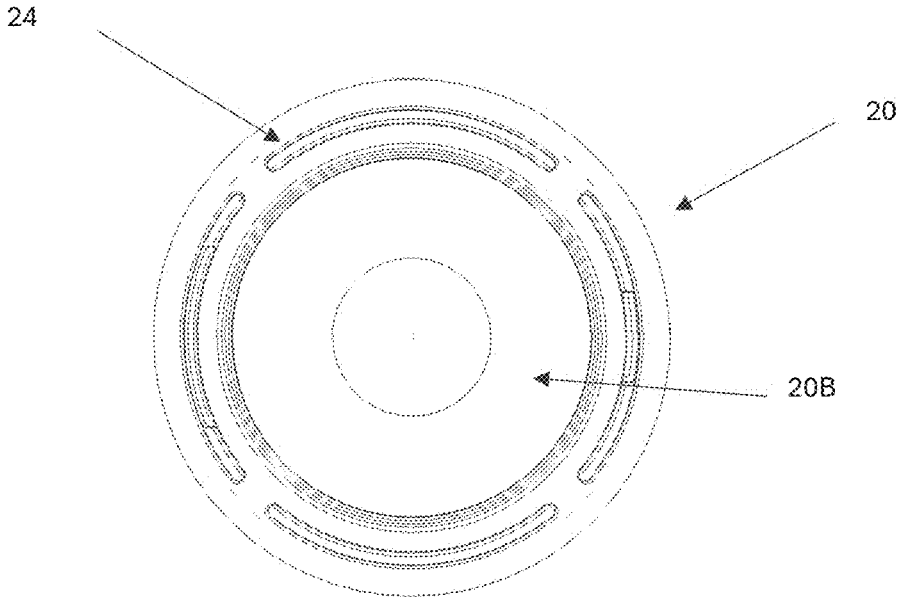
FIG. 6 is a schematic bottom view of the portable container of FIG. 1.
Figure 7:
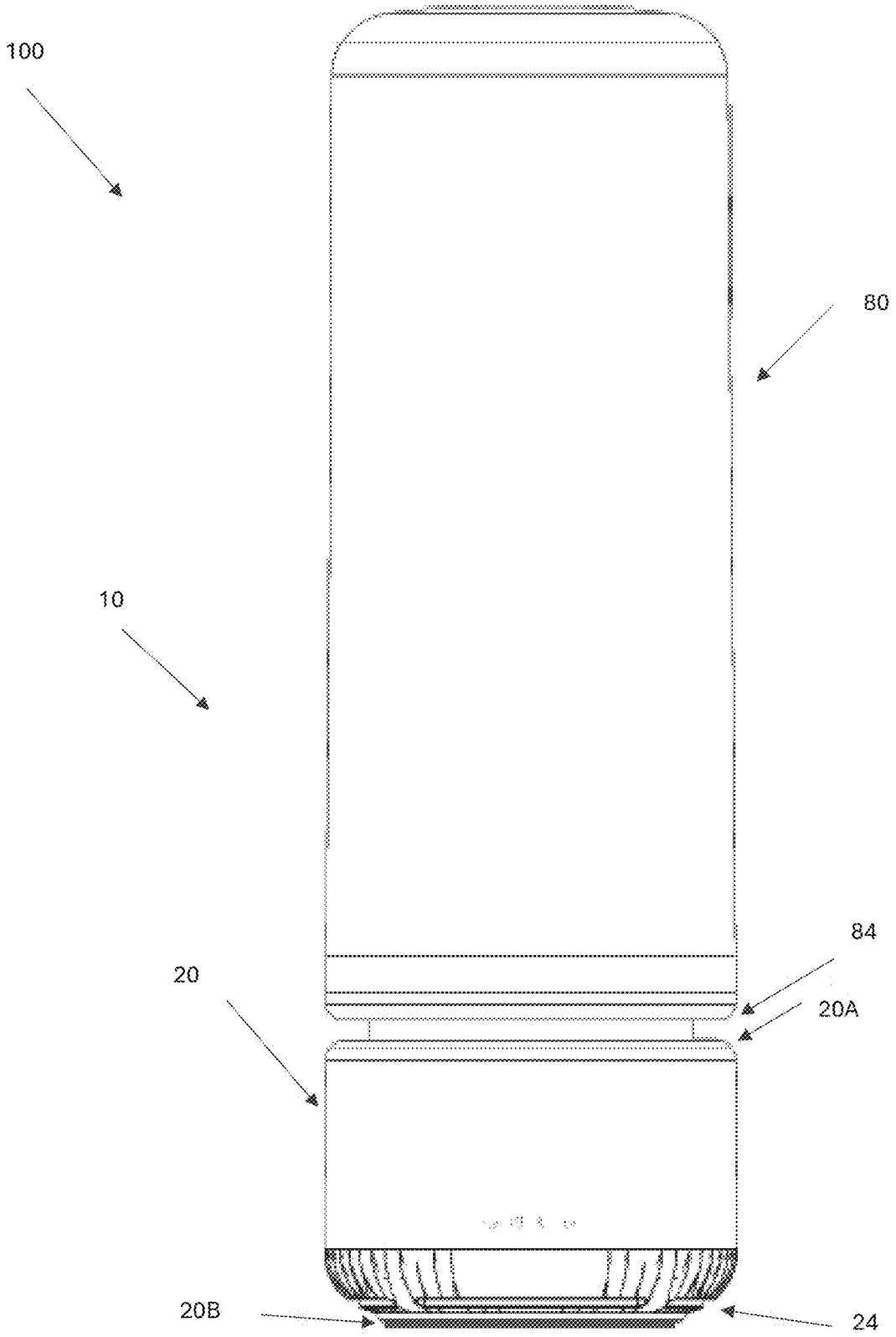
FIG. 7 is a schematic left side view of the portable container of FIG. 1.
Figure 8:
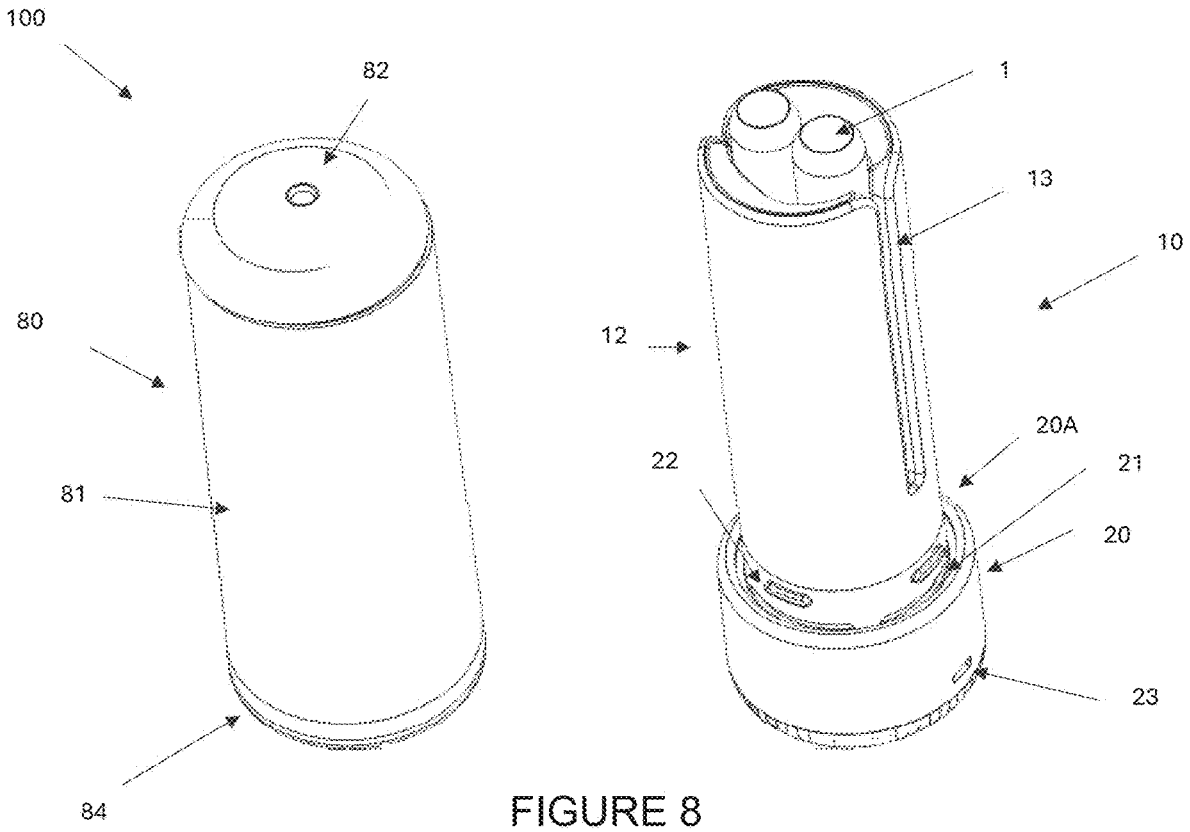
FIG. 8 is a schematic perspective exploded view of the portable container of FIG. 1.
Figure 9:
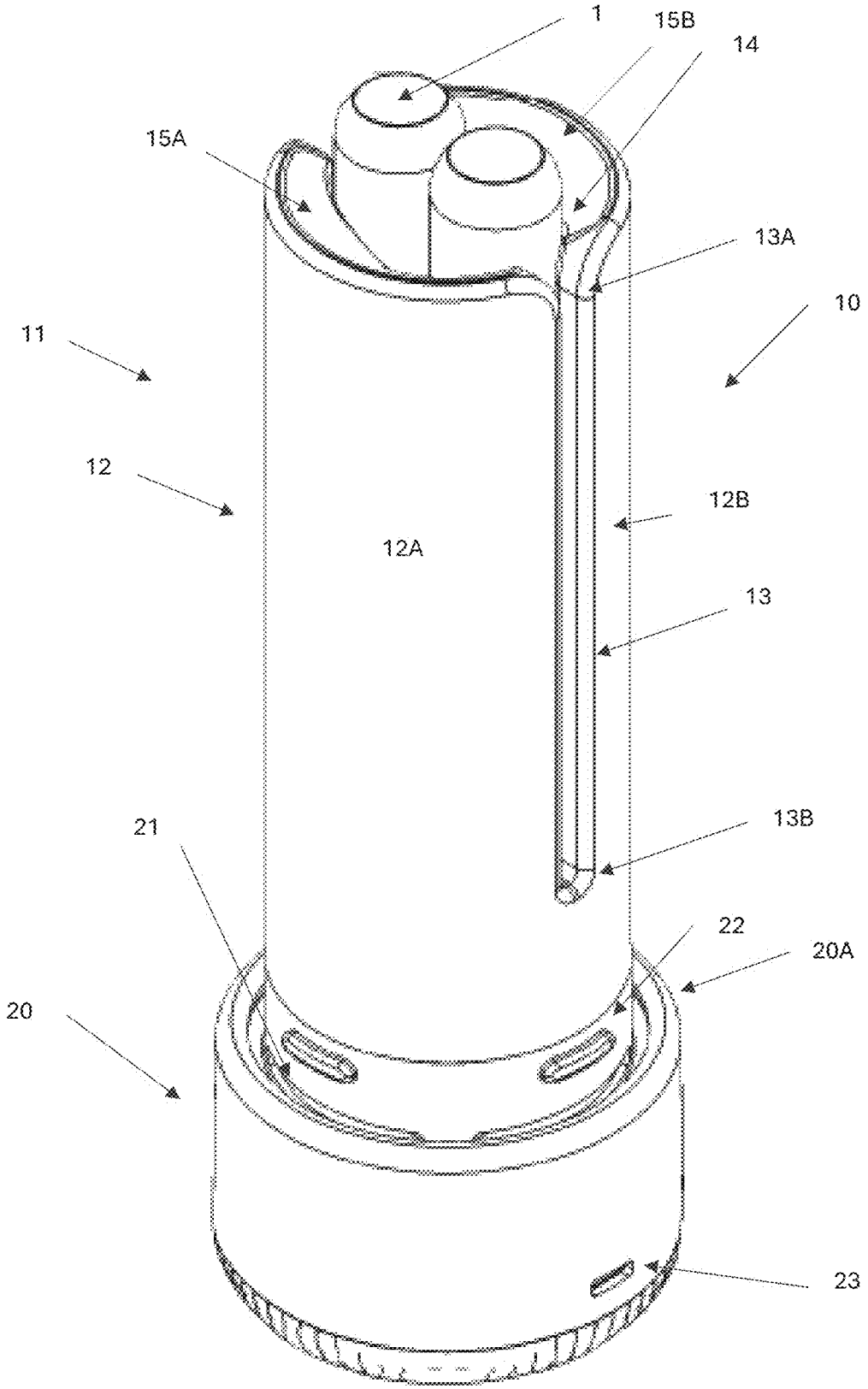
FIG. 9 is a schematic perspective view of a vessel of the portable container of FIG. 1.
Figure 10:
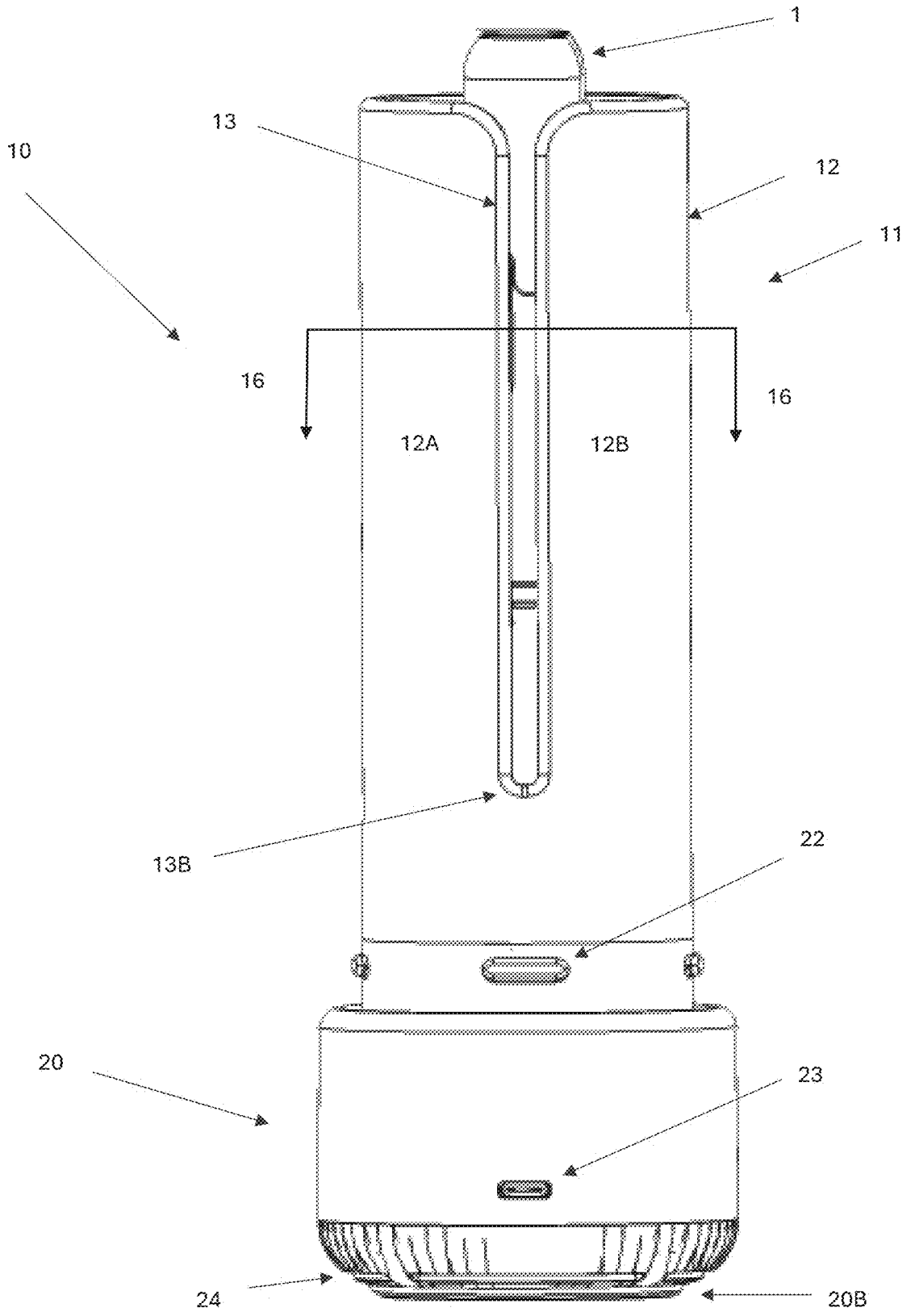
FIG. 10 is a schematic rear view of the vessel of FIG. 9.
Figure 11:
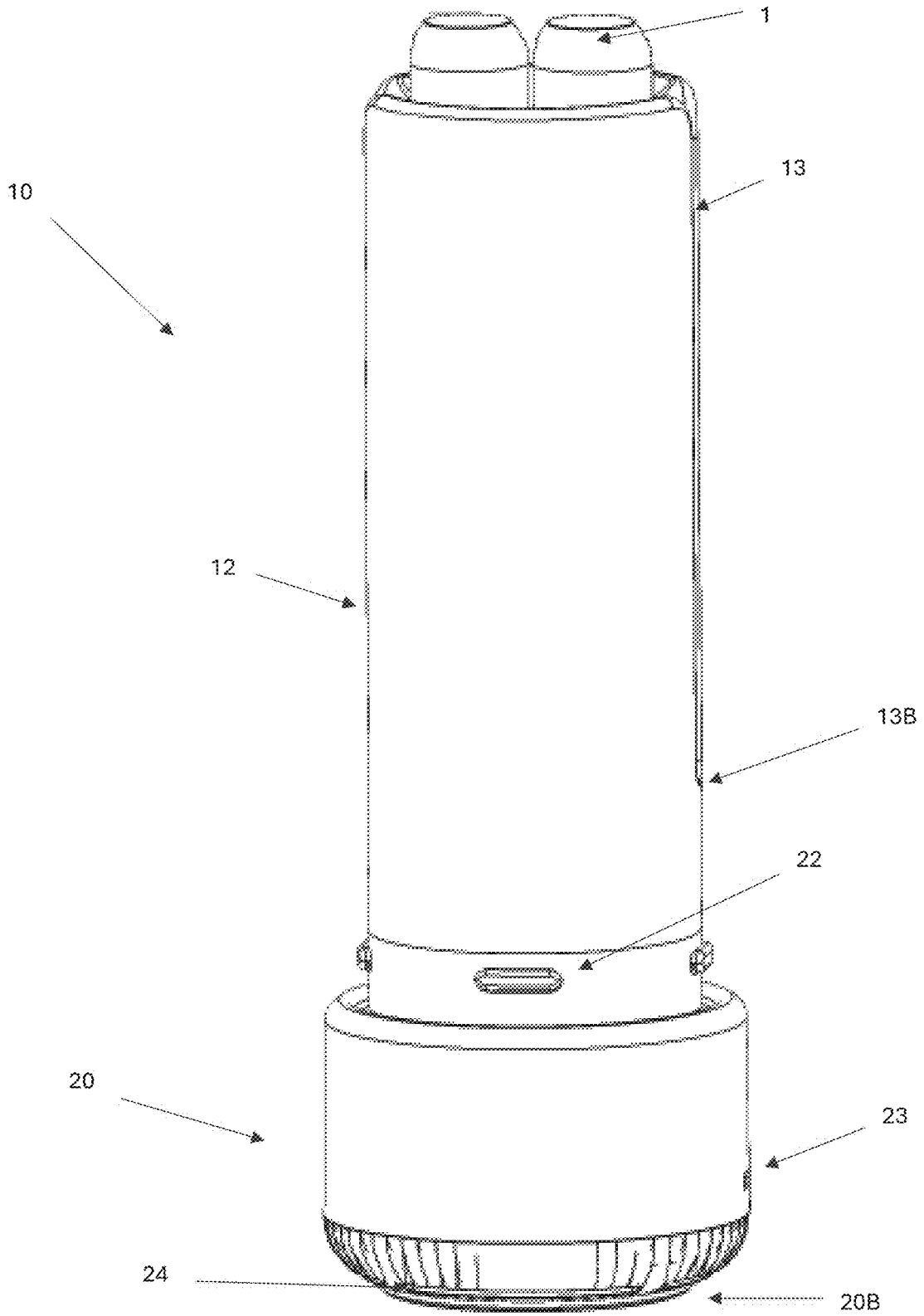
FIG. 11 is a schematic right side view of the vessel of FIG. 9.
Figure 12:
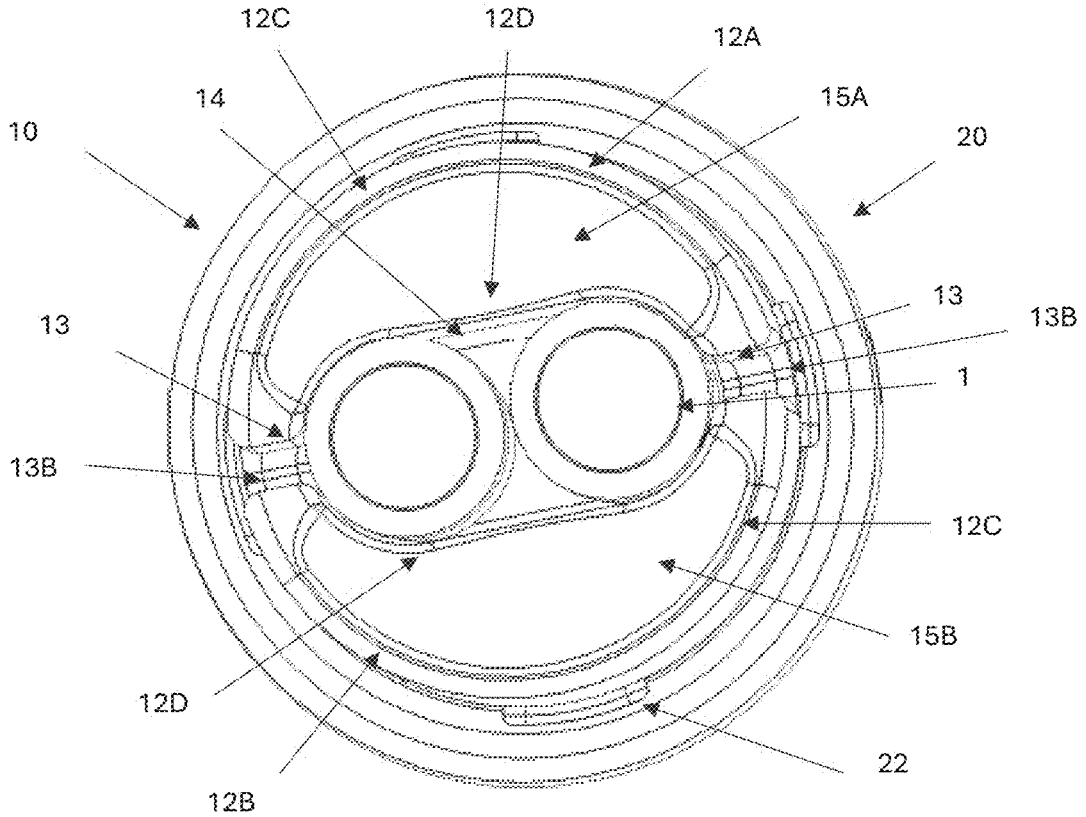
FIG. 12 is a schematic top view of the vessel of FIG. 9.

With reference to FIGS. 8-12, the cooling unit 10 can have a vessel 11 (an elongated vessel) and a base 20. The vessel 11 is attached to the base 20. The vessel 11 has a peripheral wall 12 (e.g., circumferential wall). In one example, the peripheral wall 12 is not continuous (e.g. non-continuous) and has two or more portions (e.g., first peripheral wall portion 12A, second peripheral wall portion 12B) separated by one or more slits 13 (e.g., two slits) extending from an open end 13A to a closed end 13B. The vessel 11 has an outer wall 12C with a smallest outer diameter as possible to accommodate goods 1 (e.g., injector pens, injector pen cartridges, medicine, such as two injector pens side by side as shown in FIG. 12) in a chamber 14 of the vessel 11. The chamber 14 therefore can have an elongated oval shape (as shown in FIG. 12), though other shapes are possible, as further discussed below. The one or more slits 13 extend along a majority (e.g., more than 50%, more than 75%, approximately 80% of the length) of (a length or height of) the peripheral wall 12. In another example, the slits are excluded and the peripheral wall 12 is a continuous wall (e.g., in the portable container 100 in FIG. 29). The peripheral wall 12 defines the chamber 14 (e.g. elongated chamber, open chamber) that can removably receive and hold one or more (e.g., two) goods 1 (e.g., elongated goods, elongated cylindrical goods, injector pens) side by side (e.g., proximate or adjacent each other) within the chamber 14. As shown in FIG. 10, in one example, the one or more goods 1 can protrude (e.g., extend past) a proximal end of the vessel 11 (e.g., to facilitate removal of the one or more goods 1 from the chamber 14). In one example, the vessel 11 is made of metal. In one example, the vessel 11 is made of a plastic material. In one example, the body of the base 20 is made of metal. In one example, the body of the base 20 is made of a plastic material. In one example, the vessel 11 is readily detachable from the base 20 and interchangeable. For example, the vessel 11 can be removably coupleable to the base 20 (e.g., in a twist lock manner using a key-lock groove arrangement, with screws as shown in FIG. 14). The vessel 11 can have different designs with different chamber 14 configurations (shapes) to accommodate different goods. The particular vessel 11 design for a particular good can be selectively coupled to the base 20 (e.g., during assembly at the factory, by a provider of goods, etc.).

The peripheral wall 12 (e.g., each of the first peripheral wall portion 12A and second peripheral wall portion 12B) includes the outer wall 12C and an inner wall 12D, as shown in FIG. 12. The outer wall 12C can have an arc or hemispherical shape, so that the peripheral wall 12 has, in one example, a circular outer cross-sectional shape. The inner wall 12D can have a curved bracket or C shape. The peripheral wall 12 (e.g., the first peripheral wall portion 12A and second peripheral wall portion 12B) can have an upper or proximal wall (e.g., first upper wall 15A and second upper wall 15B) that extends between the outer wall 12C and the inner wall 12D. The chamber 14 can be sized so that the one or more goods 1 can be slid into and out of the chamber 14, and so that the one or more goods 1 is in thermal contact (e.g., in direct contact) with the inner wall 12D, as shown in FIG. 12.

The base 20 of the cooling unit 10 has a larger outer profile (e.g., larger outer diameter) than the vessel 11. The base 20 includes one or more openings 21 (e.g., a plurality of spaced apart openings circumferentially arranged about the vessel 11). The one or more openings 21 can be recessed relative to an upper end 20A (e.g., proximal end) of the base 20, and face radially outward so are not easily visible (e.g. hidden from view). The base 20 includes one or more protrusions 22 (e.g., a plurality of spaced apart protrusions circumferentially arranged about the vessel 11). The one or more protrusions 22 are sized to extend within the one or more slots 88 of the cover 80 (e.g., to provide a key-slot locking arrangement) to facilitate coupling and locking of the cover 80 to the base 20 via engagement of the slot(s) 88 and protrusion(s) 22. As shown, for example, in FIGS. 1-4, when the cover 80 is coupled to the base 20, the open end 84 of the cover 80 is spaced from the upper end 20A (e.g., proximal end 20A) of the base 20, thereby allowing air to pass between the open end 84 of the cover 80 and the upper end 20A of the base and through the one or more openings 21. The base 20 has a bottom end 20B (e.g., distal end), and one or more openings 24 (e.g., a plurality of spaced apart openings 24 circumferentially arranged about the base 20) proximate (e.g., adjacent) the bottom end 20B, and face downward so they are not easily visible (e.g. hidden from view). The one or more openings 24 can be located vertically above (e.g., proximal of) the bottom end 20B, allowing air to pass through the one or more openings 24 without being obstructed by the bottom end 20B or a surface on which the base 20 is supported. With reference to FIGS. 9-11, the base 20 has a connector 23 (e.g., micro-USB connector) via which power and/or data can be communicated, as further discussed below. In another example, the base 20 can have multiple (different) connectors 23.

Figure 16:
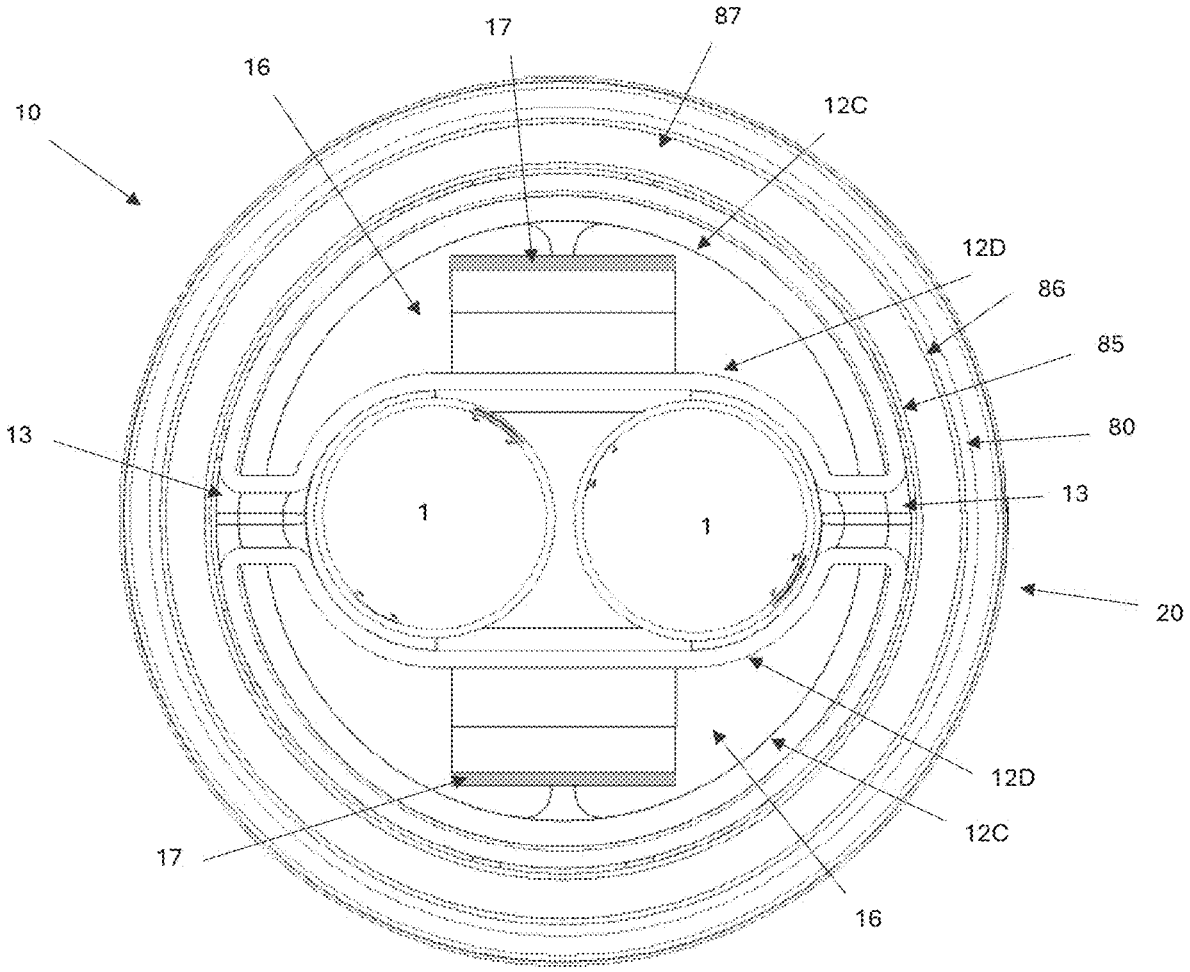
FIG. 16 is a schematic cross-sectional view of the vessel in FIG. 9 along line 16-16 in FIG. 10.

FIGS. 14-15 show lengthwise cross-sectional views of the portable container 100. The peripheral wall 12 (e.g., first peripheral wall portion 12A, second peripheral wall portion 12B) of the vessel 11 has a cavity 16 between the inner wall 12D and the outer wall 12C of the peripheral wall 12. The cavity 16 can house (e.g., enclose) a volume (e.g., fixed volume) of a phase change material or thermal mass 18 that can fill at least a portion of (e.g., a majority of, all of) the cavity 16. The slits 13 can be formed/located in portions of the peripheral wall 12 that are thinnest relative to other portions of the peripheral wall 12 (e.g., and that do not contain phase change material (PCM) or thermal mass 18). One or more thermally conductive plates 17 (e.g., metal plate, metal post) extends within the cavity 16 so that it is in thermal contact (e.g., direct contact) with the phase change material (PCM) or thermal mass 18 in the cavity 16. At least a portion of the one or more thermally conductive plates 17 can extend within the cavity 16 and spaced apart from the inner wall 12D and the outer wall 12C. The thermally conductive plate(s) 17 can extend within the cavity 16 along at least a portion of (e.g., a majority of, 50% or more of, approximately 80% of, approximately 90% of, substantially all of) the length of the peripheral wall 12 (e.g., of the first peripheral wall portion 12A, second peripheral wall portion 12B). In one example, at least a portion of the thermally conductive plate(s) 17 is linear. In one example, the one or more thermally conductive plates 17 is two plates, each extending within the cavity 16 in a different portion of the peripheral wall 12 (e.g., one plate 17 extending in the cavity 16 of the first peripheral wall portion 12A and another plate 17 extending in the cavity of the second peripheral wall portion 12B). In one example, shown in FIG. 15, the one or more thermally conductive plates 17 is two plates that extend diametrically opposite each other relative to a centerline of the portable container 100. In another example, one or more fins can be attached to the one or more thermally conductive plates 17 and extend perpendicular thereto within the cavity 16 (e.g., to increase thermal contact with the phase change material (PCM) or thermal mass 18 in the cavity 16). In another example, wire or mesh can be attached to the one or more thermally conductive plates 17 and extend within the cavity 16 (e.g., to increase thermal contact with the phase change material (PCM) or thermal mass 18 in the cavity 16). In one example, the one or more thermally conductive plates 17 have an L-shaped cross-section, as shown in FIG. 15. In one example, the one or more thermally conductive plates 17 can have a rectangular cross-section, as shown in FIG. 16. However, the one or more thermally conductive plates 17 can have other suitable cross-sectional shapes.

The one or more thermally conductive plates 17 are in thermal contact (e.g., direct contact) with a support base 19, which is in thermal contact (e.g., direct contact) with a side of one or more thermoelectric modules 30 (e.g., one or more Peltier modules). In one example, the one or more thermoelectric modules 30 can be one thermoelectric module 30. An opposite side of the one or more thermoelectric modules 30 is in thermal contact (e.g., direct contact) with a heat sink 32 (e.g., the thermoelectric module(s) 30 are disposed between the support base 19 and the heat sink 32). The heat sink 32 can have one or more (e.g., a plurality of) fins 33 (e.g., spaced apart from each other). The base 20 houses a fan 34, one or more power storage devices 36 or batteries, circuitry 38 electrically connected to the connector 23 (e.g., micro-USB connector), and circuitry 40 (e.g., one or more printed circuit boards with one or more processors, memory, wireless communication modules including transceivers, cell radio antennas, etc.), such as for communicating with a remote electronic device (e.g., smartphone, smart watch, tablet computer, laptop computer, desktop computer, etc.) or with the cloud (e.g., a cloud based storage). In one example, circuitry 38 is excluded. In one example, the power storage devices 36 or batteries to power the one or more thermoelectric modules 30 and fan 34 are excluded from the portable container 100 and the one or more thermoelectric modules 30 and fan 34 are operated when the portable container 100 is connected to power via a cable connecting a power source (e.g., wall power) to the connector 23. In this example, the portable container 100 may still have one or more power storage devices or batteries to power the circuitry 40, sensors 37 and other electronics, but not power the one or more thermoelectric modules 30 and fan 34.

With continued reference to FIGS. 15-16, in one example the heat sink 32 is at least partially housed in the base 20, the support base 19 is housed in the vessel 11, and the one or more thermoelectric modules 30 are, in one example, disposed between the vessel 11 and the base 20. However, in other examples, the one or more thermoelectric modules can be housed in the base 20 or in the vessel 11. The support base 19 can in one example define the bottom of the cavity 16.

In operation, in one example, the one or more thermoelectric modules 30 are operated to draw heat from the support base 19 (which is thermally conductive, such as made of metal) and to transfer said heat to the heat sink 32. The fan 34 is operated to draw air through the one or more openings 21 (e.g., air intake openings), past the heat sink 32 (e.g., between and past the fins 33 of the heat sink 32) and of the one or more openings 24 (e.g., air exhaust openings), for example along flow path F shown in FIG. 15. By drawing heat from (e.g., cooling) the support base 19, the thermoelectric module(s) 30 draw heat from (e.g., cool) the one or more thermally conductive plates 17, which in turn draw heat from (e.g., cool) the phase change material (PCM) or thermal mass 18 in the cavity 16. The one or more thermally conductive plates 17 thus operate as heat pipes to transfer heat from the phase change material (PCM) or thermal mass 18 to the support base 19, and thereafter to the heat sink 32 via operation of the thermoelectric module(s) 30. The thermoelectric module(s) 30 can operate to charge (e.g., solidify, freeze) the phase change material or thermal mass 18 in the cavity 16 of the vessel 11. Operation of the fan 34 dissipates heat from the heat sink 32, allowing the one or more thermoelectric modules 30 to remove more heat from the phase change material (PCM) or thermal mass 18 and transfer it to the heat sink 32, and thereby allows the one or more thermoelectric modules 30 to further charge (e.g., cool, freeze, solidify) the phase change material (PCM) or thermal mass 18. The portable container 100 can have one or more sensors 37 (e.g., temperature sensor(s), GPS sensor(s), motion sensor(s) such as gyroscopes and accelerometers, lid sensor(s) for sensing whether cover 80 is coupled to vessel 11, pressure sensor(s), capacitive touch sensor(s)) for sensing one or more parameters. The one or more sensors 37 can communicate with circuitry 40, as further discussed below, which can communicate data from the one or more sensors 37 to a remote electronic device (e.g., smartphone, table computer, laptop computer) or cloud (e.g., cloud-based storage, from which data can be displayed on a screen, such as of a mobile device, such a dashboard on a screen of a mobile electronic device).

In one example, the one or more thermoelectric modules 30 operate only to charge (e.g., to solidify or freeze) the phase change material (PCM) or thermal mass 18. The portable container can have one or more temperature sensors (e.g., adjacent the inner wall 12D and/or outer wall 12C) that sense a temperature in the cavity 36 and communicate with the circuitry 40 (e.g., via electrical wiring that extends from the one or more sensors 37 to the circuitry 40). The circuitry 40 can determine, based at least on the sensed temperature from said one or more temperature sensors, and from information (e.g., saved in memory of the circuitry 40) on the transition (e.g., solidification, freezing) temperature of the phase change material (PCM) or thermal mass 18, when the phase change material (PCM) or thermal mass 18 has been charged (e.g., frozen, solidified), for example to a desired amount, to then cause the operation of the one or more thermoelectric modules 30 to cease. For example, the circuitry 40 can stop supplying power from the one or more power storage devices 36 or batteries to the one or more thermoelectric modules 30 and fan 34. In another example, where power storage devices 36 or batteries are excluded, the circuitry 40 can stop supplying power to the one or more thermoelectric modules 30 and fan 34 from a power source (e.g., wall power) connected to the connector 23 via a cable.

Once the phase change material (PCM) or thermal mass 18 is charged, it can (passively) maintain the chamber 14 (and the one or more goods therein) in a temperature controlled (e.g., cooled) state, e.g. at a temperature at or below ambient temperature, for a prolonged period of time (e.g., 2 hours, 4 hours, 6 hours, 8 hours, 10 hours, 12 hours, etc.), with the fan 34 and thermoelectric module(s) in an unpowered state. The cover 80 can be extended over the vessel 11 so that the inner wall 85 of the cover 80 is adjacent (e.g., in sliding contact with) the outer wall 12C of the peripheral wall 12 (e.g., of the first peripheral wall portion 12A and second peripheral wall portion 12B), as shown in FIGS. 14-15. Advantageously, this facilitates maintaining of the goods 1 in the temperature controlled state for a longer period of time as the cover 80 inhibits heat transfer between the environment to the phase change material (PCM) or thermal mass 18 (e.g., because of the insulation, such as vacuum, in the gap 87). In one example, the phase change material (PCM or thermal mass 18 can have a transition temperature of between about 0 degrees Celsius and about 30 degrees Celsius (e.g., 0 Celsius, 1 Celsius, 2 Celsius, 3 Celsius, 4 Celsius, 5 Celsius). In one example, the phase change material (PCM or thermal mass 18 can have a transition temperature of about 6 degrees Celsius. In one example, the phase change material (PCM or thermal mass 18 can have a transition temperature of about 0 degrees Celsius. In one example, the phase change material (PCM or thermal mass 18 can have a transition temperature of about 8 degrees Celsius. The circuitry 40 can (automatically) operate the thermoelectric module(s) 30 and fan 34 to again charge the phase change material (PCM) or thermal mass 18 when the state of charge of the phase change material (PCM) or thermal mass 18 decreases below a certain amount (e.g., below 25%, below 15%, below 10% state of charge). In another example, the circuitry 40 can operate the thermoelectric module(s) 30 and/or fan 34 to actively cool the chamber 14 by actively heating or cooling the phase change material (PCM) or thermal mass 18 via the thermally conductive plates 17.

In another example, the one or more thermoelectric modules 30 are operated to input heat into the support base 19 (which is thermally conductive, such as made of metal) and to transfer said heat to the one or more thermally conductive plates 17, and to cool the heat sink 32. In this example, the one or more thermoelectric modules 30 are operated to heat the thermally conductive plates 17 to thereby charge (e.g., heat, melt) the phase change material (PCM) or thermal mass 18. Once charged (e.g., heated, melted as needed), the phase change material (PCM) or thermal mass 18 can (passively) maintain the chamber 14 (and the one or more goods therein) in a temperature controlled (e.g., heated) state, e.g. at a temperature at or above ambient temperature, for a prolonged period of time, with the fan 34 and thermoelectric module(s) in an unpowered state. The circuitry 40 can (automatically) operate the thermoelectric module(s) 30 and fan 34 to again charge the phase change material (PCM) or thermal mass 18 when the state of charge of the phase change material (PCM) or thermal mass 18 decreases below a certain amount (e.g., below 25%, below 15%, below 10% state of charge). In another example, the circuitry 40 can operate the thermoelectric module(s) 30 and/or fan 34 to actively heat the chamber 14 by actively heating or cooling the phase change material (PCM) or thermal mass 18 via the thermally conductive plates 17.

By maintaining the goods in a temperature controlled state, the portable container 100 advantageously maintains the goods 1 in a preferred state (e.g., maintains medicine in a temperature range that maintains its potency and/or efficacy). Advantageously, this allows the portable container 100 to travel (e.g., to be hand-carried by a user, to be carried in a bag, purse, backpack, suitcase) while traveling (e.g., by plane, boat, car, rain) for long periods of time, while maintaining the goods in the temperature controlled state. In one example, where the goods 1 are medicine (e.g., a vaccine, insulin, epinephrine, medicine injector pens, medicine injector cartridges), the portable container 100 can advantageously maintain them in a cooled state.

FIGS. 17-21A show another example of the portable container 100. The structure and description for the various features of the portable container 100 and how it's operated and controlled in FIGS. 1-16 are understood to also apply to the corresponding features of the portable container 100 in FIGS. 17-21A, except as described below, and the features of the portable container 100 described below for FIGS. 17-21A and how they are operated are understood to also apply to the portable container 100 in FIGS. 1-16.

As shown in FIGS. 17-20B, the base 20 can include a visual display 25. The visual display 25 can include one or more lights (e.g., one or more light emitting diodes (LEDs)). In one example, the visual display can include one or more hidden-til-lit LEDs. The visual display 25 can be electrically connected (e.g., via electrical wiring) to the circuitry 40. In one example, the visual display 25 can visually display a state or stage of charge of the phase chamber material (PCM) or thermal mass 18 to provide a user with an indication of the amount of charge or time left for maintaining the one or more goods 1 in a temperature controlled state (e.g., to maintain the goods 1 in a cooled state, to maintain the goods 1 in a heated state). For example, where the visual display 25 includes a plurality (e.g., ten) lights (e.g., LEDs), the visual display 25 (controlled by the circuitry 40) can illuminate all lights when the phase change material or thermal mass 18 is fully charged, illuminate half of the lights when the phase change material or thermal mass 18 is half-way charged, illuminate ¼ of the lights when the phase change material or thermal mass 18 is ¼ charged, etc.

In another example, the visual display 25 can be an electronic display screen that displays alphanumeric characters and can display the state or stage of charge alphanumerically (e.g., display "100%" when fully charged, display "50%" when half-way charged, display "25%" when ¼ charged, etc.). Additionally or alternatively, the visual display 25 can display an indication of the temperature, for example temperature of the phase change material or thermal mass 18 and/or temperature of the chamber 14, based on sensed data from the one or more sensors 37 (e.g., sensed temperature data from the one or more temperature sensors) communicated to the circuitry 40, which is then displayed on the visual display 25. Additionally, or alternatively, the visual display 25 can display an indication of a state of charge (e.g., 100% when fully charged, 50% when half-charged, 25% when ¼ charged, etc.) of one or more power storage devices 36 or batteries in the portable container 100.

Figure 17:
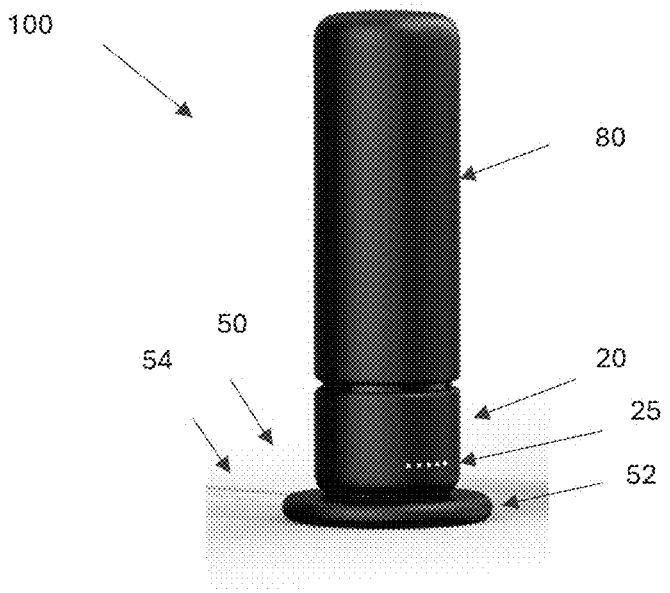
FIG. 17 is a schematic view of the portable container disposed on a charging base.
Figure 18:
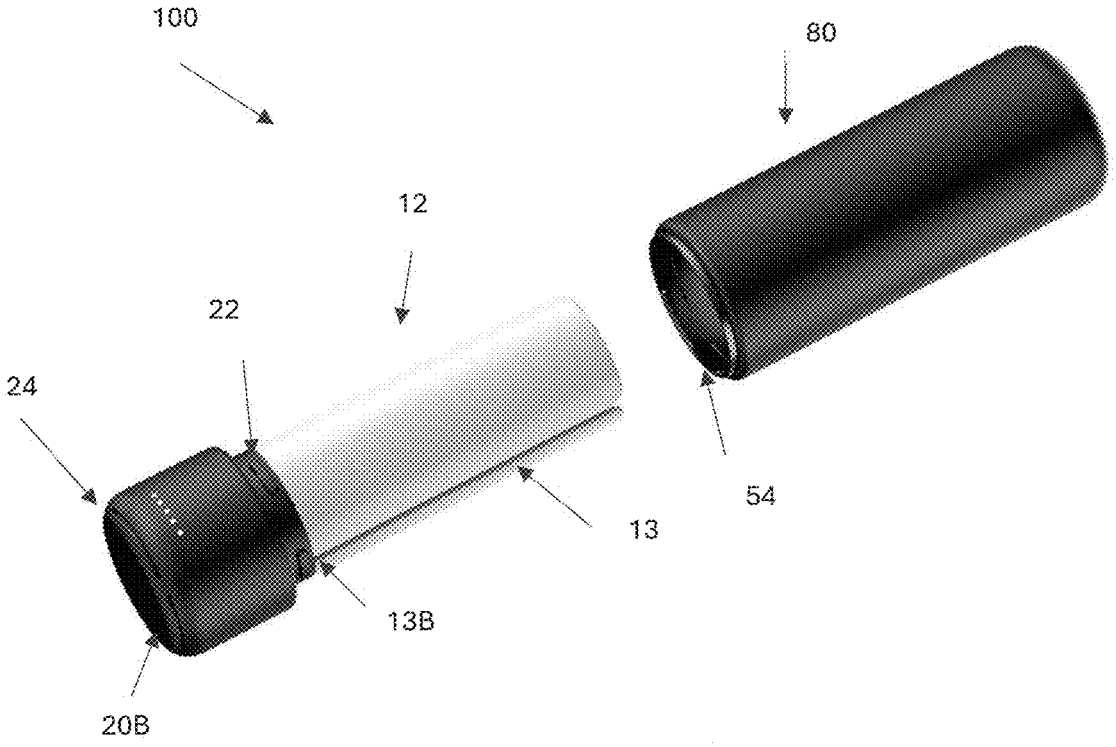
FIG. 18 is a schematic exploded view of the portable container of FIG. 17, showing the cover decoupled from the vessel for the portable container.
Figure 19:
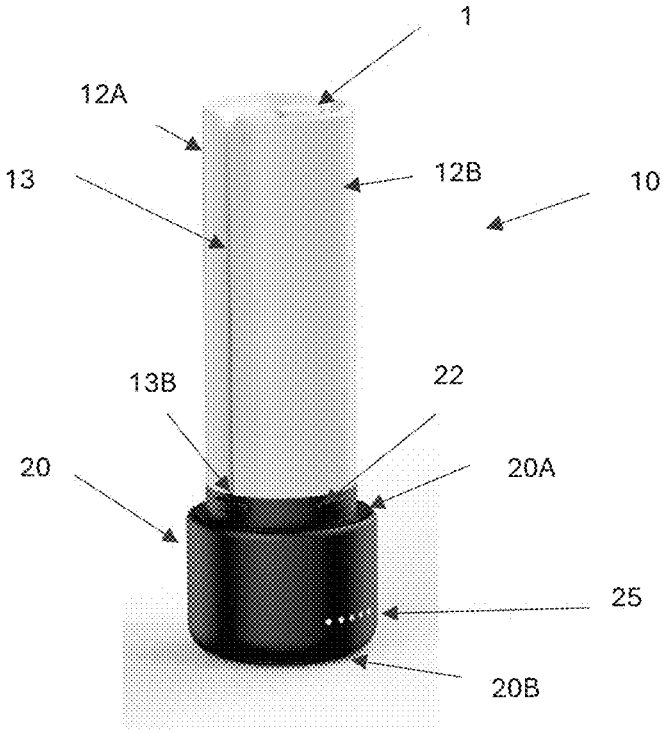
FIG. 19 is a schematic perspective view of the vessel of the portable container in FIG. 17.
Figures 20A, 20B:
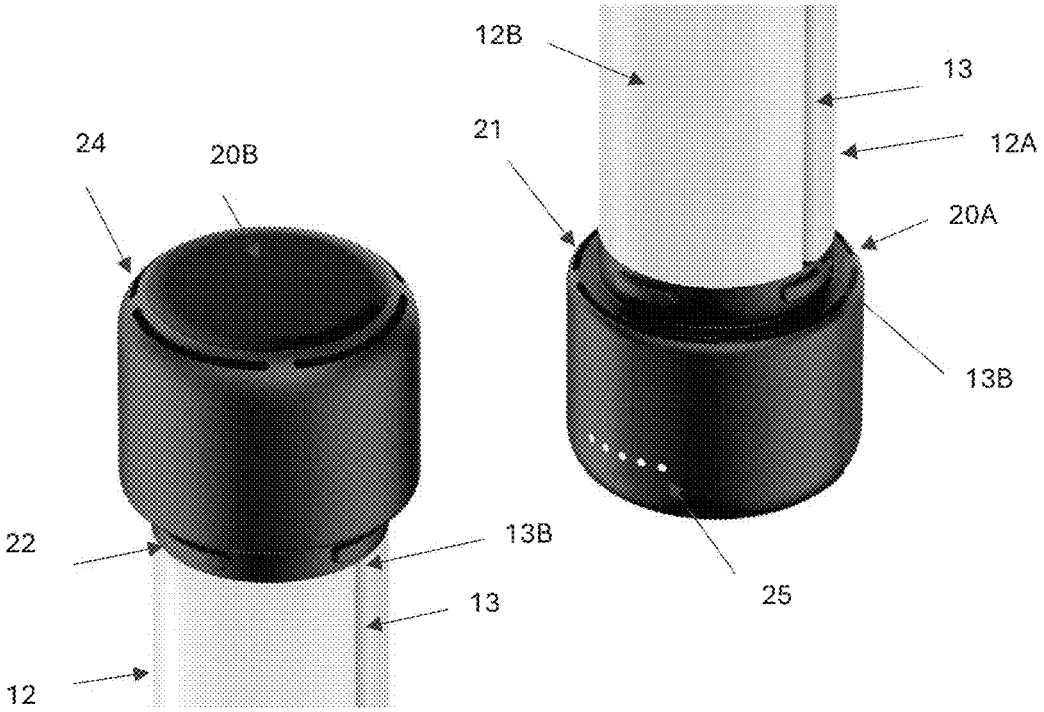
FIG. 20A is a schematic partial bottom perspective view of a base of the vessel of the portable container in FIG. 17.
FIG. 20B is a schematic partial top perspective view of a base of the vessel of the portable container in FIG. 17.
Figure 21A:
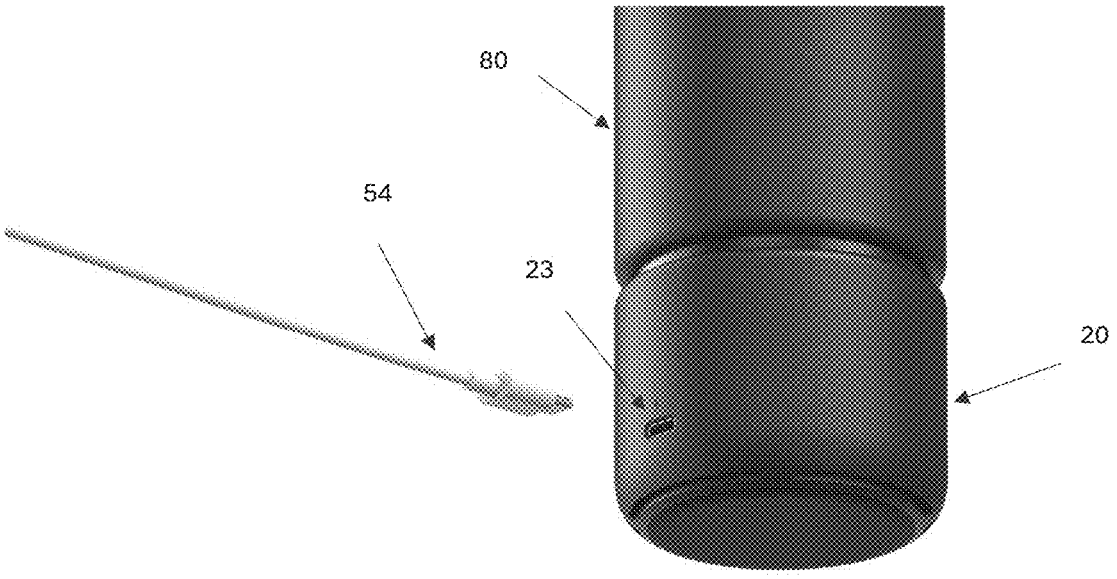
FIG. 21A is a schematic partial view of the portable container of FIG. 17 and a cable for transferring power and/or data with the portable container.
Figures 21B, 21C:
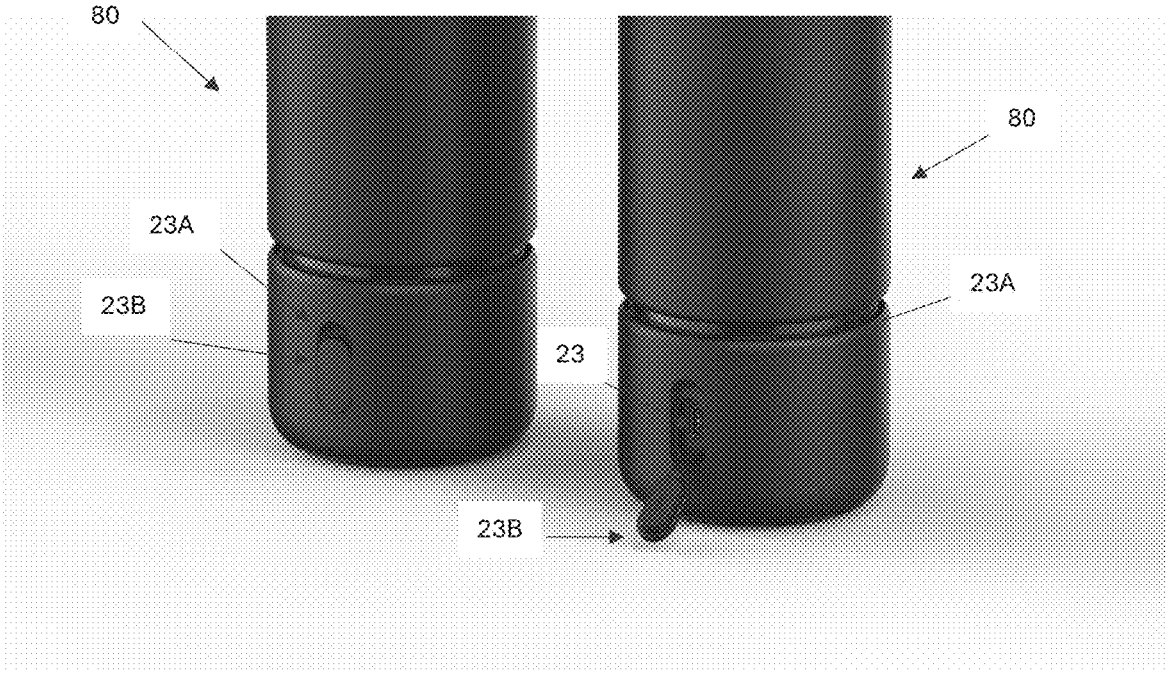
FIGS. 21B-21C show partial schematic top perspective views of the portable container of FIG. 17 showing a power and/or data port covered (FIG. 21B) with a cover and uncovered (FIG. 21C).
Figures 22A, 22B:
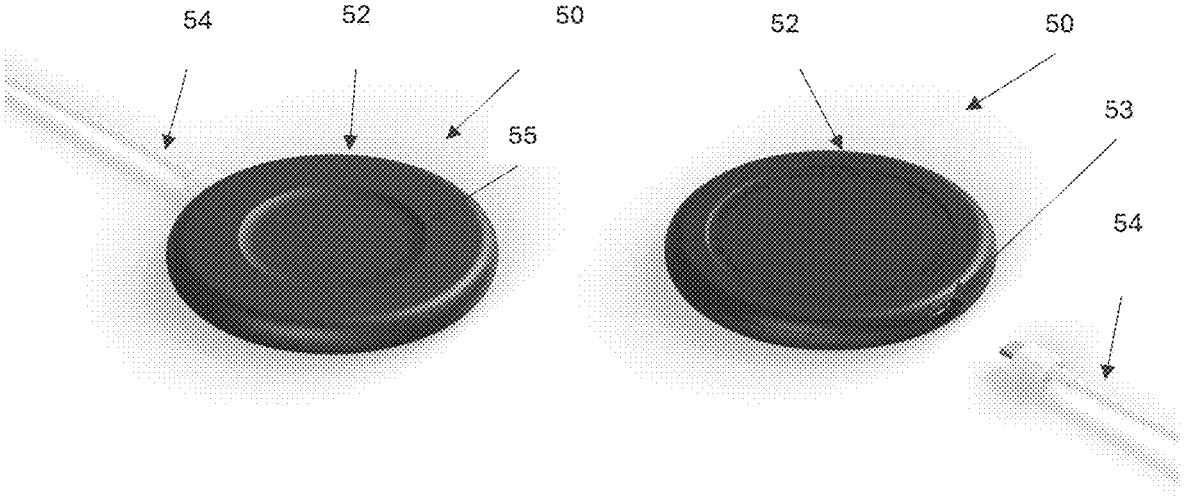
FIGS. 22A-22B show schematic perspective views of a charging base for use with the portable container of FIG. 17, with a power cable attached to a base of the charging base (FIG. 22A) and the cable detached from the base of the charging base (FIG. 22B).

As shown in FIG. 18, the closed end 13B of the one or more slits 13 extend to the base 20 (e.g., extend along substantially all or all of the length of the peripheral wall 12). With reference to FIGS. 17 and 22A-22B, a charging unit 50 can include a charging base 52 (or power base) and power cable 54 that can, in one example, removably connect to a connector 53 of the charging base 52. Optionally, the charging base 52 can have a recess 55 that receives the base 20 thereon when the portable container 100 is disposed on the charging base 52. In one example, the charging unit 50 can charge the one or more power storage devices 36 or batteries (e.g., wirelessly via induction power transfer to a wireless power receiver 27 or induction coil, or conductively via electrical contacts on the charging base 52 and electrical contacts (e.g., ring contacts) on the bottom of the base 20) when the portable container 100 is disposed on the charging unit 50 so that the base 20 is disposed on the charging base 52. Alternatively, the cable 54 can be connected to the connector 23 in the base 20, as shown in FIG. 21A to charge the one or more power storage devices 36 or batteries. In another example, shown in FIGS. 21B-21C, the connector 23 of the base 20 can be disposed in a recess 23A that is selectively covered with a cover 23B. FIG. 21B shows the cover 23B disposed in the recess 23A over the connector 23, and FIG. 21C shows the cover 23B removed from the recess 23A to expose the connector 23.

Figure 23A:
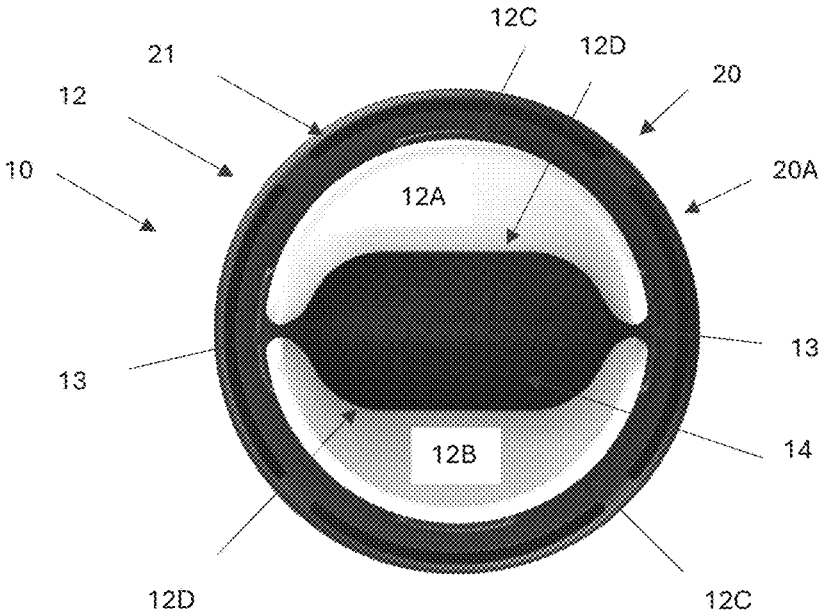
FIG. 23A shows a schematic top view of the vessel in the portable container of FIG. 17.

FIG. 23A shows a top view of the cooling unit 10 showing the chamber 14 empty (e.g., without the one or more goods, for example injector pens or cartridges, disposed in the chamber 14). The chamber 14 has a generally elongated oval (e.g., similar to a racetrack oval) shape defined by the inner wall 12D of the peripheral wall 12 (e.g., of the first peripheral wall portion 12A and second peripheral wall portion 12B). The chamber 14 can be sized so that the one or more (e.g., two) goods are adjacent (e.g., in contact with) each other, as shown in FIG. 12. The one or more openings 21 on the upper end 20A of the base 20 face upward so are visible in the top view shown in FIG. 23A.

Figure 23B:
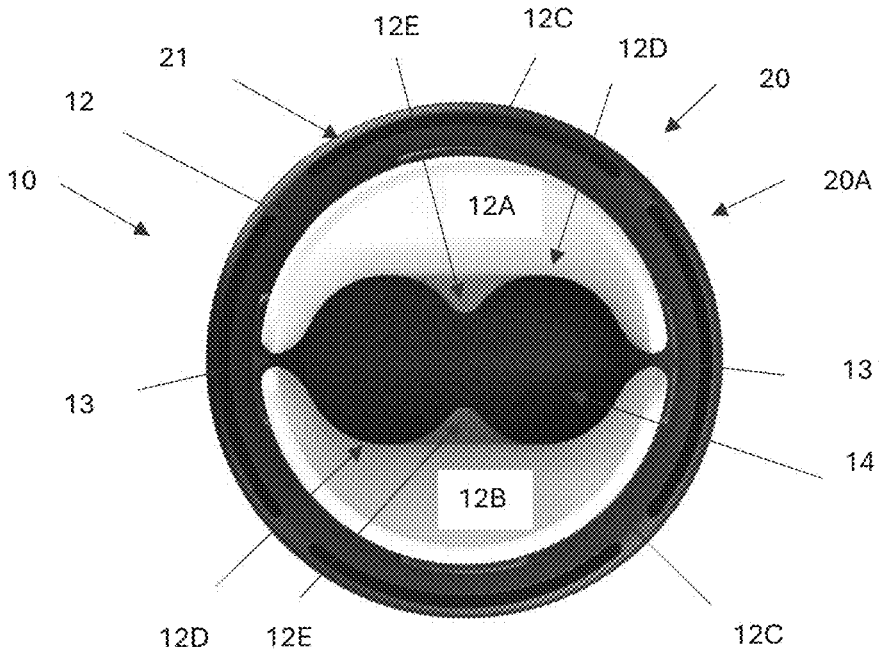
FIG. 23B shows a schematic top view of an alternate vessel for the portable container of FIG. 17.

FIG. 23B shows an alternative top view of the cooling unit showing the chamber empty (e.g., without the one or more goods, for example injector pens or cartridges, disposed in the chamber 14). The chamber 14 has a generally 8-shaped opening defined by the inner wall 12D of the peripheral wall 12 (e.g., of the first peripheral wall portion 12A and second peripheral wall portion 12B), where opposite peaks 12E are defined by the inner wall 12D of the peripheral wall 12 (e.g., of the first peripheral wall portion 12A and second peripheral wall portion 12B). The chamber 14 can be sized so that the one or more (e.g., two) goods are spaced apart from (e.g., not in contact with) each other by the opposite peaks 12E. The opposite peaks 12E therefore inhibit (e.g., prevent) contacts between the one or more (e.g., two) goods in the chamber 14.

Figure 24:
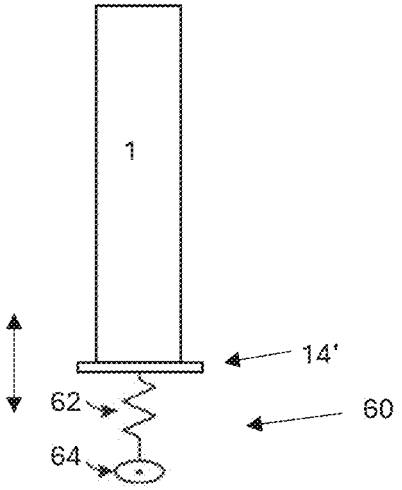
FIG. 24 is a schematic view of an actuation mechanism for us with the portable container.

FIG. 24 shows an example mechanism 60 for selectively extending at least one of the one or more goods 1 from the chamber 14 so that at least a portion of the one or more goods 1 extends from the open end of the chamber 14 (e.g., to facilitate removal of the good from the portable container 100 by the user). The actuation mechanism 60 can also selectively retract at least one of the one or more goods 1 into the chamber 14 so that the one or more goods 1 does not extend from the open end of the chamber 14 (e.g., to maintain a majority of, substantially all of, or all of the one or more goods 1 in the chamber 14, such as adjacent the inner wall 12D to thermally condition the one or more goods 1 along their length in the chamber 14). In the illustrated example, the chamber 14 can include or house a movable plate 14' on which at least one of the one or more goods 1 is supported. The movable plate 14' can be selectively moved relative to adjacent portions of the chamber 14 (e.g., adjacent lateral portions of a base of the chamber 14). The mechanism 60 can be (at least partially or completely) housed in the base 20. The mechanism 60 can include a spring 62 (e.g., a compression spring) attached to or in communication with the movable plate 14' and an actuator 64. In one example, the actuator 64 is a cam (e.g., a ratchet cam) that can move between a first orientation or position to position (or allow) the movable plate 14' to extend upward to extend at least a portion of the one or more goods 1 out of the chamber 14 and a second orientation or position to position (or allow) the movable plate 14' to retract downward (and be locked in position) to retract at least a portion of the one or more goods 1 into the chamber 14. In one example, the mechanism 60 is manually actuated (e.g., by a user) by pushing the good down to unlock the position of the movable plate 14' to thereby allow the movable plate 14' to move to the extended position. The mechanism 60 can be manually actuated (e.g., by a user) by pushing the good 1 down again to move and lock the position of the movable plate 14' in the retracted position. The mechanism 60 can in one example be a push-push actuation mechanism for moving the movable plate 14' (and therefore the good 1 supported by the movable plate 14') between the extended and retracted positions. In another example, the mechanism 60 is electronically actuated; for example, the actuator (e.g., cam) can be electronically controlled via the circuitry 40 (e.g., based on user input provided via a user interface on the portable container, such as the on the base 20, or provided via a remote electronic device that (wirelessly) communicates with the circuitry 40).

Figure 25:
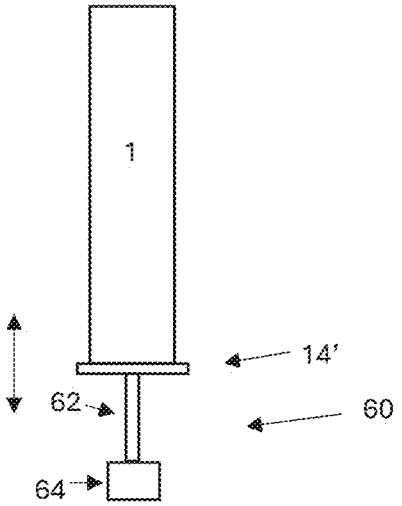
FIG. 25 is a schematic view of an actuation mechanism for us with the portable container.

FIG. 25 shows another example mechanism 60 for selectively extending at least one of the one or more goods 1 from the chamber 14 so that at least a portion of the one or more goods 1 extends from the open end of the chamber 14 (e.g., to facilitate removal of the good from the portable container 100 by the user). The actuation mechanism 60 can also selectively retract at least one of the one or more goods 1 into the chamber 14 so that the one or more goods 1 does not extend from the open end of the chamber 14 (e.g., to maintain a majority of, substantially all of, or all of the one or more goods 1 in the chamber 14, such as adjacent the inner wall 12D to thermally condition the one or more goods 1 along their length in the chamber 14). In the illustrated example, the chamber 14 can include or house a movable plate 14' on which at least one of the one or more goods 1 is supported. The movable plate 14' can be selectively moved relative to adjacent portions of the chamber 14 (e.g., adjacent lateral portions of a base of the chamber 14). The mechanism 60 can be (at least partially or completely) housed in the base 20. The mechanism 60 can include a linear member 62 (e.g., a rod, threaded screw such as a lead screw) attached to or in communication with the movable plate 14' and an actuator 64. In one example, the actuator 64 is an electric motor that linearly moves the movable plate 14' between the extended position and the retracted position via the linear member 62. In one example, the linear member is a lead screw that is rotated by the actuator 64, which then linearly moves another portion (e.g., screw) of the linear member to linearly move the movable plate 14' (e.g., rotated in one direction to move the movable plate 14' toward the extended position, rotated in an opposite direction to move the movable plate 14' toward the retracted position). In another example, the linear member 62 is a piston and the actuator 64 is a hydraulic or pneumatic actuator that linearly move the linear member 62 to thereby linearly move the movable plate 14' and the one or more goods 1 supported by the movable plate 14'. In one example, the mechanism 60 is electronically actuated; for example, the actuator 64 can be electronically controlled via the circuitry 40 (e.g., based on user input provided via a user interface on the portable container, such as the on the base 20, or provided via a remote electronic device that (wirelessly) communicates with the circuitry 40).

With reference to the mechanism 60 and movable plate 14' in FIGS. 24-25, the chamber 14 can have one movable plate 14' that supports all goods in the chamber 14. In this example, the mechanism 60 can be actuated to extend all the goods 1 out of the chamber 14 at the same time and actuated to retract all of the goods 1 into the chamber 14 at the same time. In another example, the chamber can have multiple movable plates 14', each movable plate 14' having an associated mechanism 60. In this example, each of the one or more goods 1 in the chamber 14 can be moved between the extended position and the retracted position separately and independently of the other goods 1 in the chamber 14.

Figure 26:
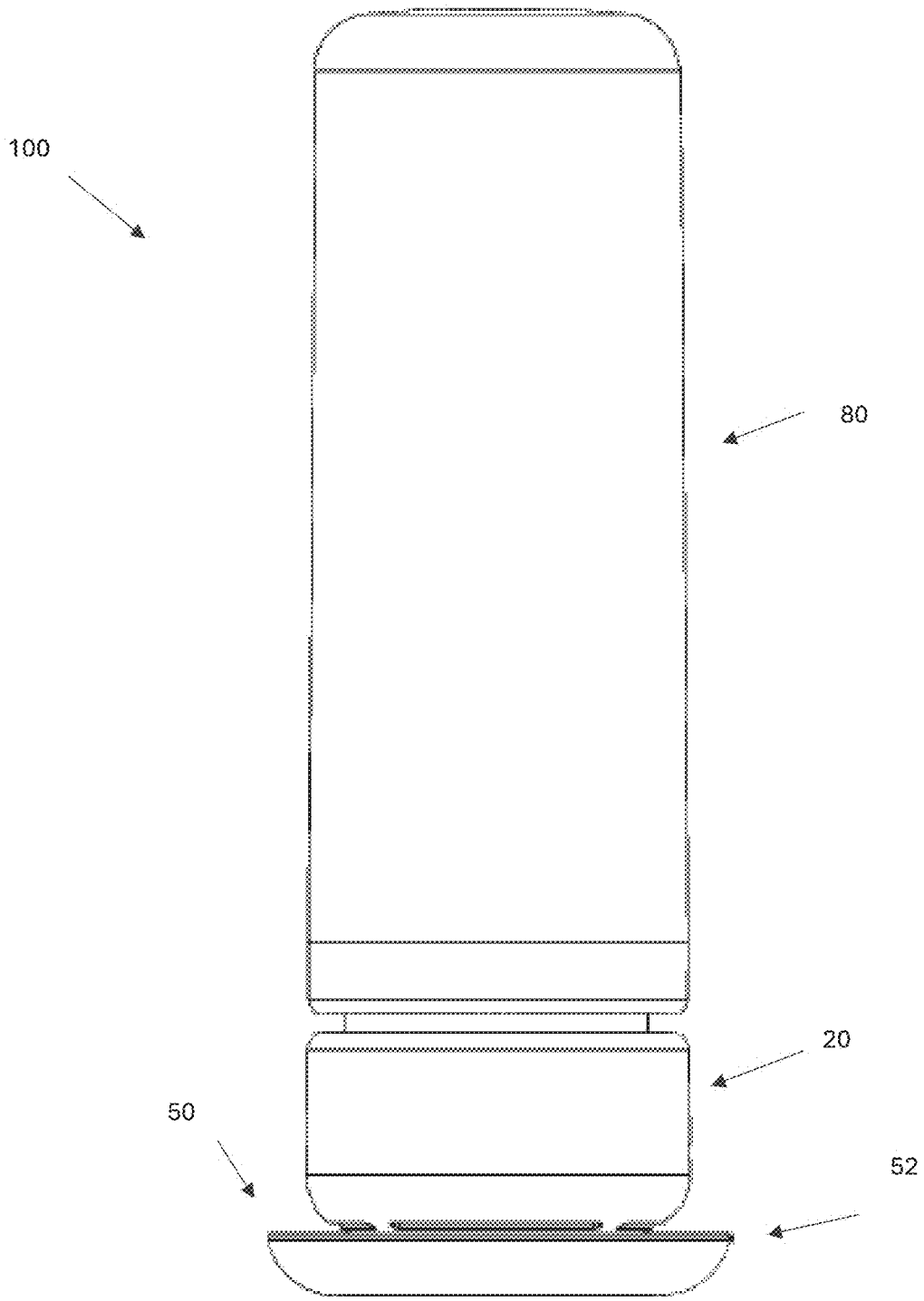
FIG. 26 is a schematic view of a portable container disposed on a charging base.
Figure 27:
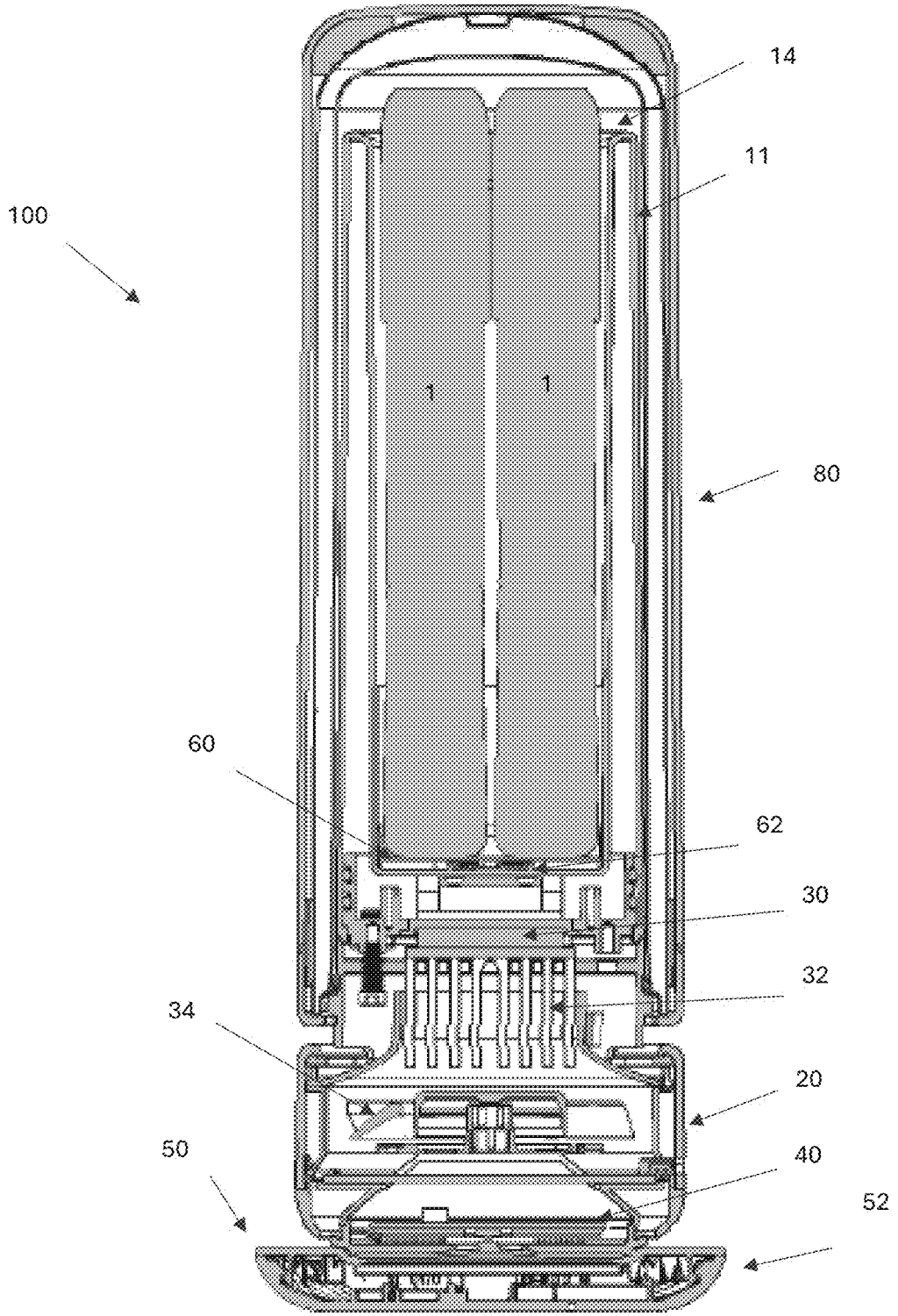
FIG. 27 is a schematic cross-sectional view of the portable container and charging base in FIG. 26.
Figure 28:
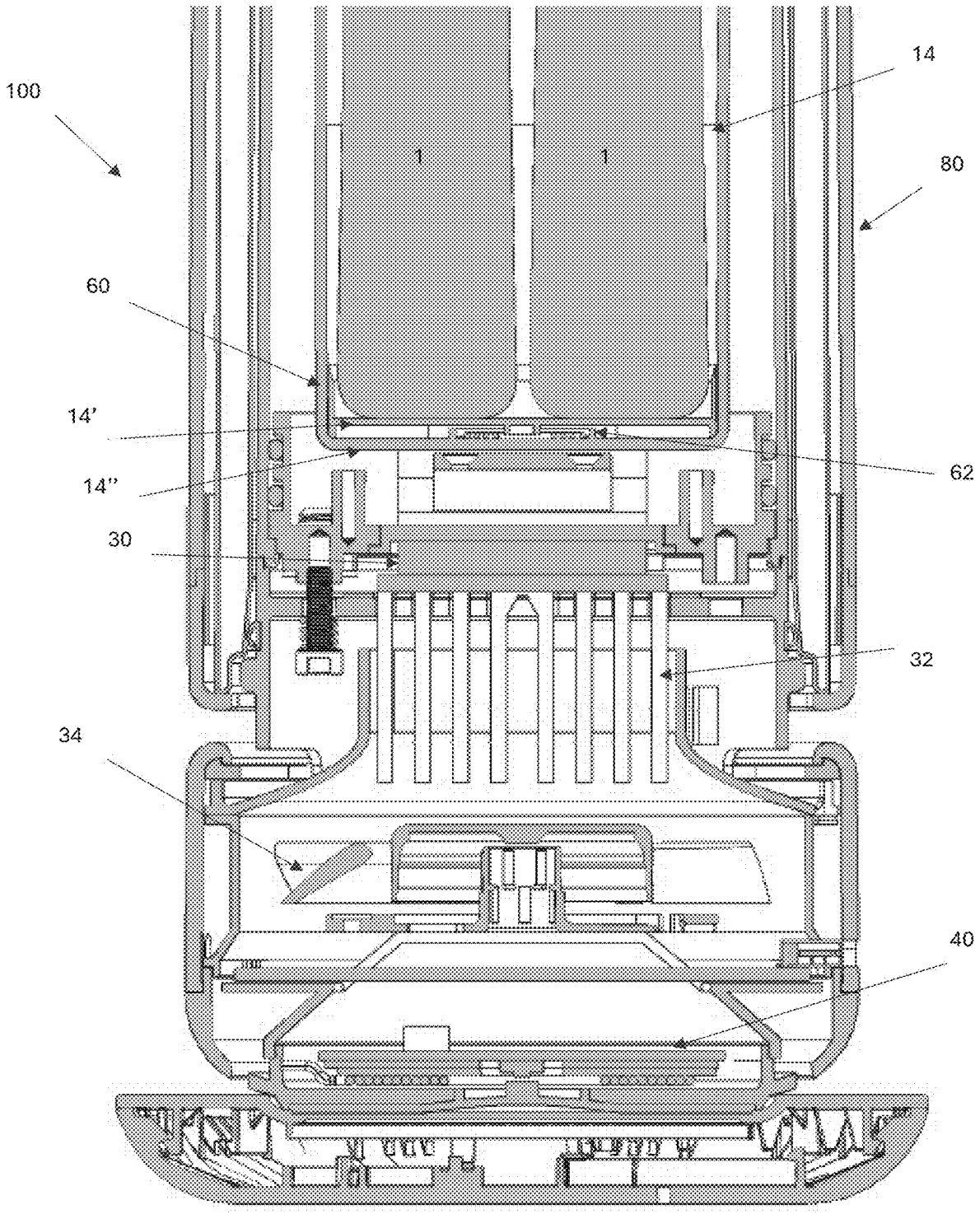
FIG. 28 is a schematic enlarged partial view of the cross-section of the portable container in FIG. 26.
Figure 29:
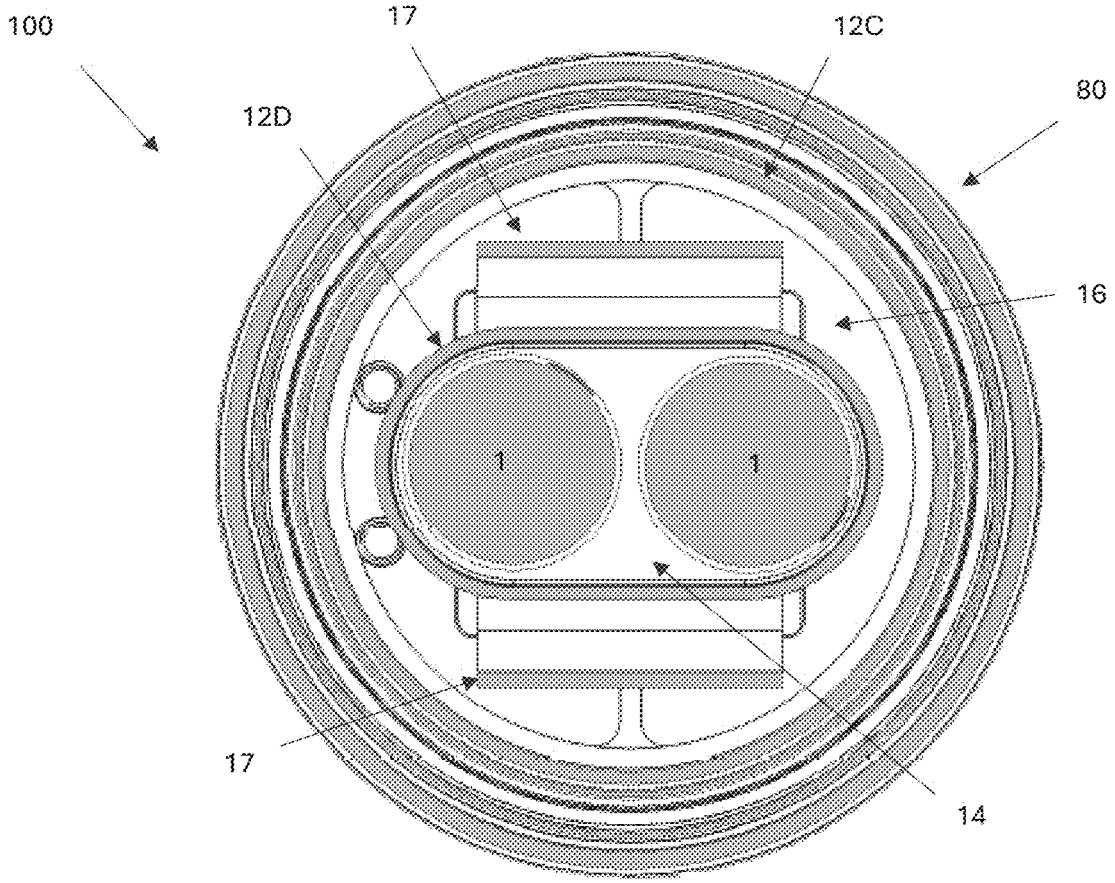
FIG. 29 is a schematic cross-sectional view of the portable container in FIG. 26.

FIGS. 26-28 show another example of the portable container 100, with FIG. 26 showing a side view of the portable container 100 disposed on a charging base 50, FIG. 27 showing a cross-section thereof, FIG. 28 showing a partial view of the cross-section in FIG. 27, and FIG. 29 is a cross-sectional view perpendicular to the longitudinal axis of the portable container 100. The structure and description for the various features of the portable container 100 and how it's operated and controlled in FIGS. 1-16 and 17-21A are understood to also apply to the corresponding features of the portable container 100 in FIGS. 26-28, except as described below, and the features of the portable container 100 described below for FIGS. 26-28 and how they are operated are understood to also apply to the portable container 100 in FIGS. 1-16 and 17-21A.

As best shown in FIG. 28, the portable container 100 includes a mechanism 60 inside the chamber 14 of the vessel 11 for supporting the one or more goods 1 (e.g., supporting one or more injector pens). The mechanism 60 includes a plate 14' on which the one or more goods 1 are supported, and a spring 62 disposed between the plate 14' and the base 14" of the chamber 14. The spring 62 can compress when the cover 80 is disposed over the vessel 11 so that the one or more goods 1 (e.g., one or more injector pens) in the chamber 14 move further into the chamber 14. When the cover 80 is removed (e.g., by a user to access the chamber 14, for example to remove an injector pen from the chamber 14 for use), the spring 62 will uncompress, moving the plate 14' upward to lift the one or more goods 1 (e.g., lift the one or more injector pens) toward the opening of the vessel 11 (e.g., extending the one or more injector pens at least partially out of the vessel 11) to facilitate removal of the one or more goods 1 by the user from the chamber 14. Additionally, the mechanism 60 inhibits (e.g., prevents) rattling or vibration of the one or more goods 1 (e.g., the one or more injector pens) while being transported (e.g., while the portable container 100 is being transported, such as hand carried or carried in a bag, purse, backpack, suitcase, etc.) due to the dampening force provide by the spring on the plate 14'.

Figure 30:
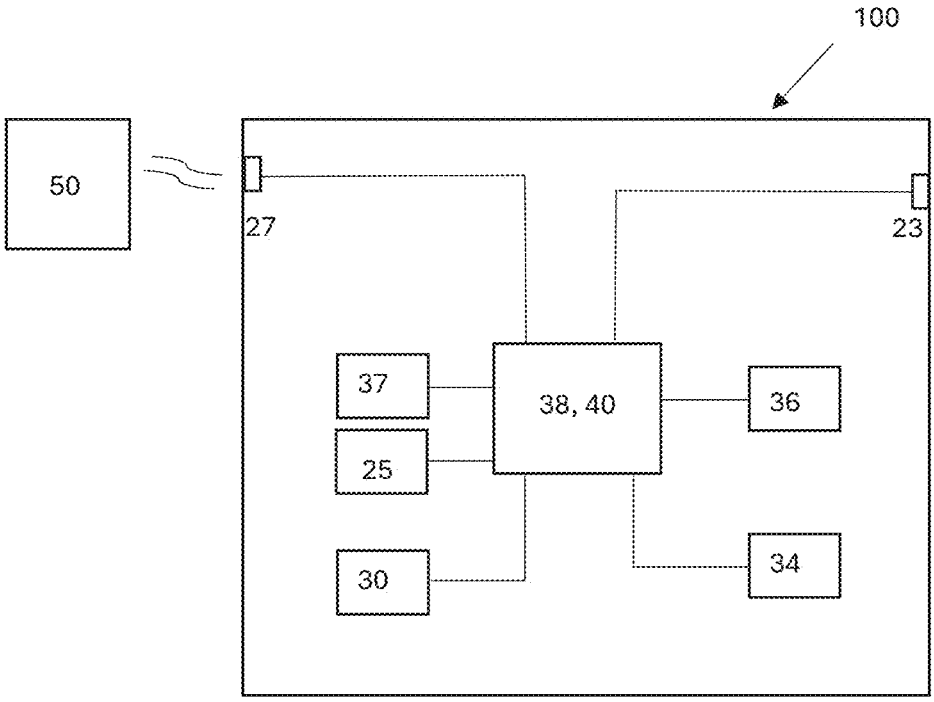
FIG. 30 is a schematic diagram of electronics of the portable container.

FIG. 30 shows a schematic diagram of electronics of the portable container 100. Power and/or data can be transferred with the circuitry 40 with a wired connection to the connector 23 (e.g., with cable 54), or via electrical contacts (e.g. ring contacts) between the charging unit 50 and the base 20, or wirelessly via wireless receiver 27 (e.g., wireless power receiver, induction coil).

Additional Examples

In examples of the present disclosure, a portable container may be in accordance with any of the following clauses:

Clause 1. A portable container, comprising: a cooling or heating unit comprising: a vessel comprising a non-continuous peripheral wall including one or more slits that separate the peripheral wall into two or more portions, the one or more slits extending from an open end to a closed end along a majority of a length of the vessel, the peripheral wall having an outer wall and an inner wall that defines an open chamber configured to receive and hold one or more goods proximate each other, the outer wall spaced from the inner wall and defining a cavity therebetween filled with a phase change material or thermal mass, one or more thermally conductive plates extending within the cavity and in thermal contact with the phase change material or thermal mass, and a base attached to the vessel, the base at least partially housing: one or more thermoelectric modules having one side in thermal contact with a thermally conductive support base in thermal contact with the one or more thermally conductive plates, a heat sink in thermal contact with an opposite side of the one or more thermoelectric modules, a fan operable to draw air through one or more intake openings into the base, flow the air past the heat sink, and exhaust the air from the base via one or more exhaust openings, one or more power storage devices, a visual display, and circuitry configured to operate the one or more thermoelectric modules, fan and visual display; and a thermal cover having a closed first end and an open second end, the thermal cover comprising an outer wall and an inner wall spaced apart from the outer wall, a gap between the inner wall and the outer wall configured to thermally insulate the inner wall relative to the outer wall, the thermal cover configured to removably extend over the vessel to close the chamber and so that the inner wall of the thermal cover is proximate the outer wall of the peripheral wall of the vessel, the thermal cover configured to thermally insulate the chamber, wherein the one or more thermoelectric modules is operable to charge the phase change material or thermal mass, the charged phase change material or thermal mass configured to passively cool or heat the chamber.

Clause 2. The portable container of clause 1, wherein the gap is under vacuum.

Clause 3. The portable container of any preceding clause, wherein the base further comprises a connector electrically connected to the circuitry and configured to transfer power or data.

Clause 4. The portable container of any preceding clause, wherein the visual display includes one or more light emitting diodes (LEDs), the visual display operable to visually indicate a state of charge of the phase change material or thermal mass.

Clause 5. The portable container of any preceding clause, further comprising one or more sensors electrically connected to the circuitry, the one or more sensors configured to sense a parameter of the phase change material or thermal mass, or of the chamber.

Clause 6. The portable container of any preceding clause, wherein the one or more intake openings and one or more exhaust openings are at opposite ends of the base and hidden from view.

Clause 7. The portable container of any preceding clause, wherein the vessel is detachable from the base and interchangeable.

Clause 8. A portable container, comprising: a cooling or heating unit comprising: a vessel comprising a non-continuous peripheral wall including one or more slits that separate the peripheral wall into two or more portions, the one or more slits extending from an open end to a closed end along a majority of a length of the vessel, the peripheral wall having an outer wall and an inner wall that defines an open chamber configured to receive and hold one or more goods proximate each other, the outer wall spaced from the inner wall and defining a cavity therebetween filled with a phase change material or thermal mass, one or more thermally conductive plates extending within the cavity and in thermal contact with the phase change material or thermal mass, and a base attached to the vessel, the base at least partially housing: one or more thermoelectric modules having one side in thermal contact with a thermally conductive support base in thermal contact with the one or more thermally conductive plates, a heat sink in thermal contact with an opposite side of the one or more thermoelectric modules, a fan operable to draw air through one or more intake openings into the base, flow the air past the heat sink, and exhaust the air from the base via one or more exhaust openings, one or more power storage devices, a visual display, and circuitry configured to operate the one or more thermoelectric modules, fan and visual display, wherein the one or more thermoelectric modules is operable to charge the phase change material or thermal mass, the charged phase change material or thermal mass configured to passively cool or heat the chamber.

Clause 9. The portable container of clause 8, wherein the base further comprises a connector electrically connected to the circuitry and configured to transfer power or data.

Clause 10. The portable container of any of clauses 8-9, wherein the visual display includes one or more light emitting diodes (LEDs), the visual display operable to visually indicate a state of charge of the phase change material or thermal mass.

Clause 11. The portable container of any of clauses 8-10, further comprising one or more sensors electrically connected to the circuitry, the one or more sensors configured to sense a parameter of the phase change material or thermal mass, or of the chamber.

Clause 12. The portable container of any of clauses 8-11, wherein the one or more intake openings and one or more exhaust openings are at opposite ends of the base and hidden from view.

Clause 13. The portable container of any of clauses 8-12, wherein the vessel is detachable from the base and interchangeable.

Clause 14. A portable container, comprising: a cooling or heating unit comprising: a vessel comprising a peripheral wall having an outer wall and an inner wall that defines an open chamber configured to receive and hold one or more goods proximate each other, the outer wall spaced from the inner wall and defining a cavity therebetween filled with a phase change material or thermal mass, one or more thermally conductive plates extending within the cavity and in thermal contact with the phase change material or thermal mass, and a base attached to the vessel, the base at least partially housing: one or more thermoelectric modules having one side in thermal contact with a thermally conductive support base in thermal contact with the one or more thermally conductive plates, a heat sink in thermal contact with an opposite side of the one or more thermoelectric modules, a fan operable to draw air through one or more intake openings into the base, flow the air past the heat sink, and exhaust the air from the base via one or more exhaust openings, and circuitry configured to operate the one or more thermoelectric modules and fan, wherein the one or more thermoelectric modules is operable to charge the phase change material or thermal mass, the charged phase change material or thermal mass configured to passively cool or heat the chamber.

Clause 15. The portable container of clause 14, wherein the base further comprises a connector electrically connected to the circuitry and configured to transfer power or data.

Clause 16. The portable container of any of clauses 14-15, further comprising one or more sensors electrically connected to the circuitry, the one or more sensors configured to sense a parameter of the phase change material or thermal mass, or of the chamber.

Clause 17. The portable container of any of clauses 14-16, wherein the one or more intake openings and one or more exhaust openings are at opposite ends of the base and hidden from view.

Clause 18. The portable container of any of clauses 14-17, wherein the circuitry is configured to wirelessly communicate with a remote electronic device.

Clause 19. The portable container of any of clauses 14-18, wherein the chamber has an elongated oval cross-sectional shape configured to receive two goods side by side.

Clause 20. The portable container of any of clauses 14-19, wherein the chamber has an 8-shaped opening configured to receive two goods side by side, the 8-shaped opening having opposite peaks that inhibit contact between the two goods.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of the stated amount. As another example, in certain embodiments, the terms "generally parallel" and "substantially parallel" refer to a value, amount, or characteristic that departs from exactly parallel by less than or equal to 15 degrees.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A portable container, comprising:

a cooling or heating unit comprising:

a vessel comprising a non-continuous peripheral wall including one or more slits that separate the peripheral wall into two or more portions, the one or more slits extending from an open end to a closed end along a majority of a length of the vessel, the peripheral wall having an outer wall and an inner wall that defines an open chamber configured to receive and hold one or more goods proximate each other, the outer wall spaced from the inner wall and defining a cavity therebetween filled with a phase change material or thermal mass, one or more thermally conductive plates extending within the cavity and in thermal contact with the phase change material or thermal mass, and a base attached to the vessel, the base at least partially housing:

one or more thermoelectric modules having one side in thermal contact with a thermally conductive support base in thermal contact with the one or more thermally conductive plates, a heat sink in thermal contact with an opposite side of the one or more thermoelectric modules, a fan operable to draw air through one or more intake openings into the base, flow the air past the heat sink, and exhaust the air from the base via one or more exhaust openings, one or more power storage devices, a visual display, and circuitry configured to operate the one or more thermoelectric modules, fan and visual display; and a thermal cover having a closed first end and an open second end, the thermal cover comprising an outer wall and an inner wall spaced apart from the outer wall, a gap between the inner wall and the outer wall configured to thermally insulate the inner wall relative to the outer wall, the thermal cover configured to removably extend over the vessel to close the chamber and so that the inner wall of the thermal cover is proximate the outer wall of the peripheral wall of the vessel, the thermal cover configured to thermally insulate the chamber, wherein the one or more thermoelectric modules is operable to charge the phase change material or thermal mass, the charged phase change material or thermal mass configured to passively cool or heat the chamber.

2. The portable container of claim 1, wherein the gap is under vacuum.

3. The portable container of claim 1, wherein the base further comprises a connector electrically connected to the circuitry and configured to transfer power or data.

4. The portable container of claim 1, wherein the visual display includes one or more light emitting diodes (LEDs), the visual display operable to visually indicate a state of charge of the phase change material or thermal mass.

5. The portable container of claim 1, further comprising one or more sensors electrically connected to the circuitry, the one or more sensors configured to sense a parameter of the phase change material or thermal mass, or of the chamber.

6. The portable container of claim 1, wherein the one or more intake openings and one or more exhaust openings are at opposite ends of the base and hidden from view.

7. The portable container of claim 1, wherein the vessel is detachable from the base and interchangeable.

8. The portable container of claim 1, wherein the circuitry is configured to wirelessly communicate with a remote electronic device.

9. The portable container of claim 1, wherein the chamber has an elongated oval cross-sectional shape configured to receive two goods side by side.

10. The portable container of claim 1, wherein the chamber has an 8-shaped opening configured to receive two goods side by side, the 8-shaped opening having opposite peaks that inhibit contact between the two goods.

11. The portable container of claim 1, wherein one or more thermally conductive plates are spaced apart from the inner wall and the outer wall.

12. The portable container of claim 1, wherein the one or more thermally conductive plates are two thermally conductive plates extending opposite each other relative to a centerline of the vessel.

13. The portable container of claim 1, wherein the one or more intake openings are recessed relative to an upper end of the base.

14. The portable container of claim 1, wherein the base includes one or more protrusions configured to engage one or more slots in the thermal cover when the thermal cover is disposed over the vessel to couple the thermal cover to the base.

15. The portable container of claim 1, wherein the chamber includes a plate on which the one or more goods is supported, the plate configured to be move relative to adjacent portions of the chamber by a mechanism to selectively extend at least one of the one or more goods from the chamber to facilitate their removal from the chamber.

16. The portable container of claim 15, wherein the mechanism includes a spring disposed between the plate and a base of the chamber, the spring configured to compress when the thermal cover is disposed over the vessel and configured to uncompress when the thermal cover is removed from over the vessel to lift at least one of the one or more goods toward an opening of the vessel to facilitate their removal from the chamber.

17. The portable container of claim 15, wherein the mechanism is at least partially housed in the base and comprises a spring attached to or in communication with the plate and an actuator.

18. The portable container of claim 17, wherein the actuator is a cam.

19. The portable container of claim 15, wherein the mechanism is at least partially housed in the base and comprises a linear member attached to or in communication with the plate and an actuator.

20. The portable container of claim 19, wherein the actuator is an electric motor.

* * * * *